US008115622B2

(12) United States Patent
Stolarczyk et al.

(10) Patent No.: US 8,115,622 B2
(45) Date of Patent: Feb. 14, 2012

(54) UNDERGROUND RADIO COMMUNICATIONS AND PERSONNEL TRACKING SYSTEM

(75) Inventors: Larry G. Stolarczyk, Raton, NM (US); Gerald L. Stolarczyk, Raton, NM (US); Igor Bausov, Raton, NM (US)

(73) Assignee: Stolar, Inc., Raton, NM (US)

( * ) Notice: Subject to any disclaimer, the term of this patent is extended or adjusted under 35 U.S.C. 154(b) by 606 days.

(21) Appl. No.: 12/275,205

(22) Filed: Nov. 20, 2008

(65) Prior Publication Data

US 2009/0140852 A1 Jun. 4, 2009

Related U.S. Application Data

(60) Provisional application No. 60/991,208, filed on Nov. 29, 2007.

(51) Int. Cl.
*G08B 1/08* (2006.01)

(52) U.S. Cl. ..... 340/539.13

(58) Field of Classification Search ..... 340/539.13, 340/573.1, 521, 572.1, 825.36, 10.1; 455/404.2
See application file for complete search history.

(56) References Cited

U.S. PATENT DOCUMENTS

| | | | | |
|---|---|---|---|---|
| 4,495,496 | A * | 1/1985 | Miller, III | 340/10.2 |
| 4,577,153 | A * | 3/1986 | Stolarczyk | 324/334 |
| 4,879,755 | A * | 11/1989 | Stolarczyk et al. | 725/41 |
| 5,432,838 | A * | 7/1995 | Purchase et al. | 455/523 |
| 5,635,907 | A * | 6/1997 | Bernard et al. | 340/573.4 |
| 2008/0076383 | A1 * | 3/2008 | Barrett et al. | 455/404.1 |
| 2008/0137589 | A1 * | 6/2008 | Barrett | 370/327 |

* cited by examiner

*Primary Examiner* — Phung Nguyen
(74) *Attorney, Agent, or Firm* — Richard B. Main

(57) ABSTRACT

An underground radio communications and personnel tracking system uses a portable communications device worn by a miner when underground in a mine. A cap-lamp transceiver provides voice and text communication on ultra-low frequency (ULF) to ultra-high frequency (UHF) carrier frequencies and modulation adapted by programming of a software defined radio to making selective and agile radio contacts via through-the-earth, conductor/lifeline, coal seam, tunnel, and ionosphere/earth-surface waveguides for transmission of electromagnetic waves. These waveguides comprise layered earth coal and mineral deposits, and manmade mining complex infrastructures which serendipitously form efficient waveguides. Ultra-Low Frequency F1/F1 repeaters are placed underground in the mine, and providing for extended range of communication of the cap-lamp transceiver with radios and tracking devices above ground of the mine.

13 Claims, 12 Drawing Sheets

UNDERGROUND RADIO COMMUNICATIONS AND PERSONNEL TRACKING SYSTEM

RELATED APPLICATIONS

This Application claims benefit of United States Provisional Patent Application, Emergency and Operational Communications and Tracking (RadCAT) System for Underground Mines, Ser. No. 60/991,208, filed Nov. 29, 2007, by Larry G. Stolarczyk, and is incorporated herein by reference.

FIELD OF THE INVENTION

The present invention relates to radio systems, and more particularly to methods and circuits for communicating with and locating miners underground.

DESCRIPTION OF THE PRIOR ART

People in general are puzzled by the failure of mine wide communications and tracking technology when mine disasters occur. They wonder why the technology is not available for this critical problem. Many laymen are quite sure that commercial off-the-shelf (COTS) communications equipment can be installed and magically, the problem will go away. When tragedies occur anyway, governments often believe that punitive mining law making is in order.

Always knowing where miners are located in a mine is critical to efforts to rescue those miners when catastrophe strikes. Often the miners themselves don't know where they are exactly. But even then it is helpful to be able to communicate with them to know they are alive and to reassure them that rescue efforts are underway.

It is well known to the average American that cellphones, navigation receivers, and other radios simply quit working when you enter a tunnel or mine. The intervening soil and rocks blocks the ordinary radio signals these devices depend on to communicate. So something special is needed, because there are no obvious traditional ways to establish communication.

Wires and waveguides are conventional ways to carry radio signals through walls and other structures to their antennas. But extensive point-to-point connections are impractical in mines, and the few wires that are strung below are often cut and disabled when an explosion or collapse occurs. So any good communications system that is going to solve the problems of locating miners and communicating with them cannot be knocked out in the first minute by the very event that caused the emergency.

What is needed is a communication system for miners that follows the movements of the miners in their normal activities, and that adapts to the changing physical conditions caused by the emergency. Both the miners and the management on the surface need to know where the miners are, and both need a reliable way to at least message one another.

SUMMARY OF THE INVENTION

Briefly, a system embodiment of the present invention comprises a transceiver disposed in a miner's cap-lamp. A number of radio repeaters are buried in periodically spaced bores in the mine shaft ceilings and walls. These collect communications and tracking locator information, and send the data up to an operations center on the surface. The cap-lamp transceiver opportunistically selects and connects through one or more of the several natural and unintended artificial waveguides that exist in a typical mine. These include waveguides formed by the mine shaft tunnels, the coal seam deposits, random pipes and wires, and yellow life lines.

An advantage of the present invention is that a radio communicator is provided that function even after collapses and explosions have destroyed conventional communications lines.

Another advantage of the present invention is that a device is provided that reports each last known location of a miner automatically and passively as they pass by strategically place recording stations in the mine.

These and other objects and advantages of the present invention no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

Figure 1:
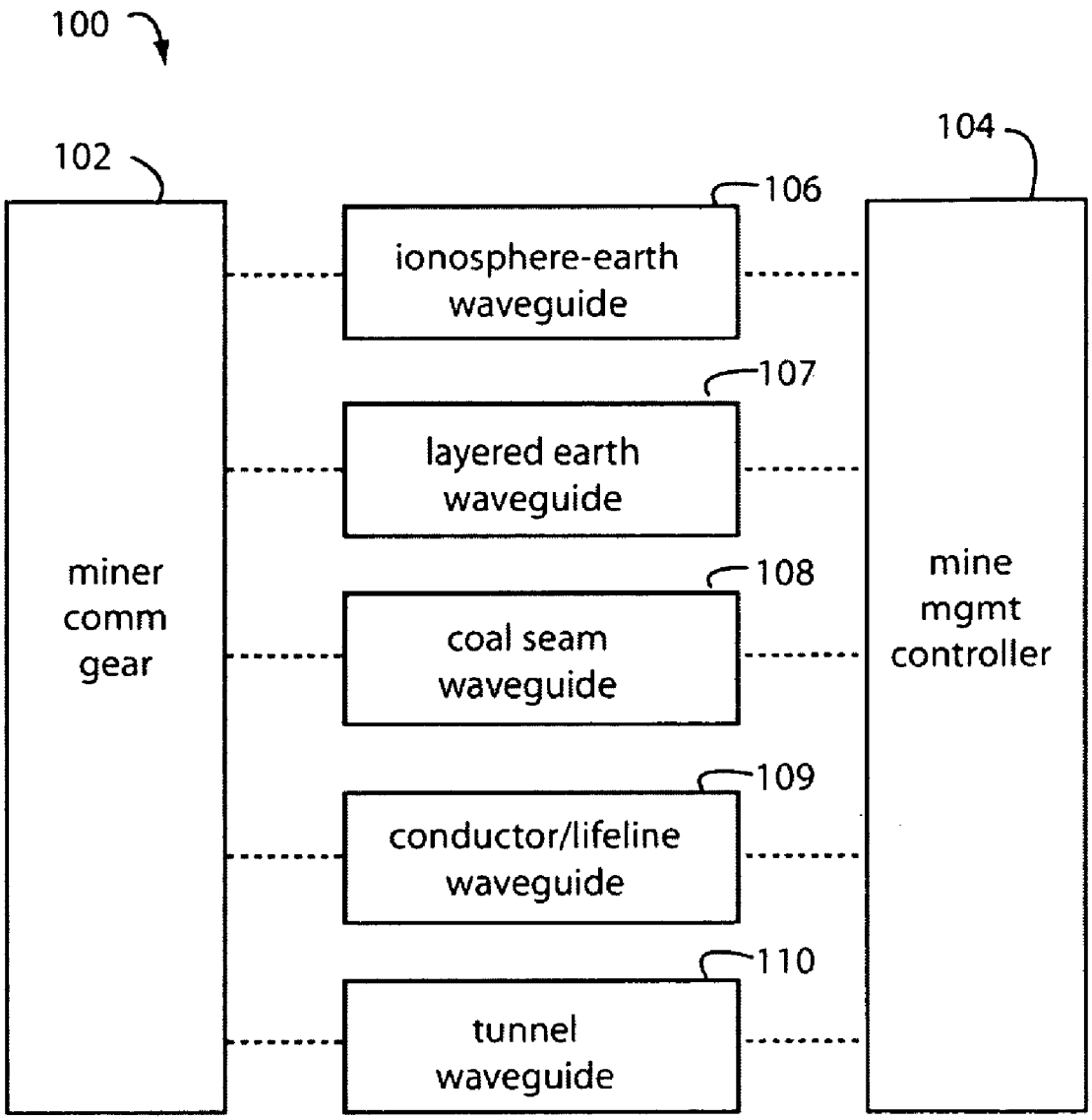
FIG. 1 is a schematic diagram of a radio-transmitter power-output amplifier for use in a wireless telemetry device.

In FIG. 1, a mine wide wireless emergency and operational radio communications and tracking system (RadCAT) 100 takes advantage of at least five different radio waveguides that is exploited within a typical mining complex infrastructure. Miner communication gear 102 can communicate with a mine management controller 104 over several different radio communication medium and pathway channels 106-110. Each has an optimum carrier frequency and communication bit rate that is controlled by the physics on the mediums involved. For example, an ionosphere earth surface-waveguide (IEW) 106 can support multiple bands, a layered earth waveguide (LEW) 107 uses the UHF band and a 12-80 bps rate, a coal seam waveguide (CSW) 108 uses the LF band and an 1800-bps rate, a conductor/life line waveguide (CLLW) 109 uses the LF band and a 4800-bps rate, and a tunnel waveguide (TW) 110 can support a very wide bandwidth UHF/fiberoptic. The miner communication gear 102 and mine management controller 104 must both provide appropriate transceivers for each communication channel 106-110, and adapt in real time as each channel independently and unpredictably fades in and out.

Channels 106-110 change their characteristics very slowly as the mine topology evolves. Characteristics change too as the individual miners move about, and very quickly when catastrophes strike. The miner communication gear 102 includes a cap-lamp transceiver implemented with a software definable transceiver (SDT) for text messaging, voice communication, and tracking with passive radio frequency identification (RFID) tags installed in every entry at regular intervals.

A mine wide emergency transmission system includes narrow bandwidth F1/F1 repeaters with radio carriers that operate in the ultra low frequency (ULF) 300-3000 Hz band and low frequency (LF) 30-300 kHz bands. Multi-frequency and modulation capabilities are realized by using a software-definable transceiver (SDT) design. The digital core electronics design can thus be shared between the cap-lamp transceivers and F1/F1 repeaters.

A so-called "Yellow-CAT" lifeline capable of supporting low frequency (LF) Hill-Wait bifilar mode of transmission is installed in any of the entries of a mining complex. A Yellow-CAT cable is augmented with a multi-fiberoptic cable for very wide bandwidth transmission. Each face power center and refuse chamber is equipped with 2000-Hz through-the-earth transmission facilities.

Electromagnetic (EM) waves propagating in an ionosphere-earth waveguide 106, or coal seam waveguide 108, typically exhibit a vertically polarized electric field component and horizontally polarized magnetic field component. Electrodynamic boundary conditions are such that a negative charge builds up at the top boundary (ionosphere) and a positive charge builds up at the bottom (earth). Electric field vectors start on a positive charge and end on a negative charge. The build up of charge on each boundary causes a weaker horizontally polarized electric field component to exist. The polarization alternates every half wavelength of travel distance. The transmission mode is quasi-transverse electromagnetic (quasi-TEM). The horizontally polarized electric and magnetic field components are responsible for transmission of energy through the surface interface and into the through-the-earth waveguide. Cloud to cloud lightning discharges can significantly increase the magnitude of the horizontal field components.

The coal seam waveguide 108 supports quasi-TEM transmission modes, and is cut off for higher order modes. The ionosphere-earth waveguide 106 supports terrestrial modes including direct, ground wave and reflections from the ionosphere boundary. The conductor-life line waveguide 109 supports both monofilar and bifilar transmission modes. These modes enable mine-wide wireless communication and tracking in emergency and operational conditions.

The ionosphere-earth waveguide (IEW) 106 dominates in the trapped miner communications and tracking problem. The usual radio frequency interference (RFI) in the IEW is often orders of magnitude greater than the magnitude of a surface signal (S) propagating upward from a trapped miner. Surface text message communications to trapped miners requires suppression of the surface RFI noise by factors of one hundred (40-dB) to 1,000 (60-dB).

The very high reflection loss at the free space-earth boundary and the high absorption (attenuation rate) of the signal traveling through natural media can cause problems. The ionosphere-earth waveguide (IEW) is formed by layers of trapped solar wind charged ions approximately 100 Km above the earths surface upper (ionosphere) and lower (earth) conductive layers. A lightning strike anywhere on the earth's surface initiates quasi-TEM EM wave transmissions that circle the earth with the electrical (E) and magnetic (M) field components alternating polarity.

The traveling field components continually exchange energy between the electric and magnetic fields along the transmission path. The distance traveled for the energy to be completely transferred to the other field component and back again is a wavelength (λ), which is represented mathematically by, $$\lambda = \frac{c}{f\sqrt{\varepsilon_r}} \text{ in meters,} \tag{1-1}$$

where, $c=3\times10^8$ is the speed of light in meters per second, f=the frequency of the energy exchange in hertz, and $\in_r$=the relative dielectric constant of the natural media.

Figure 2:
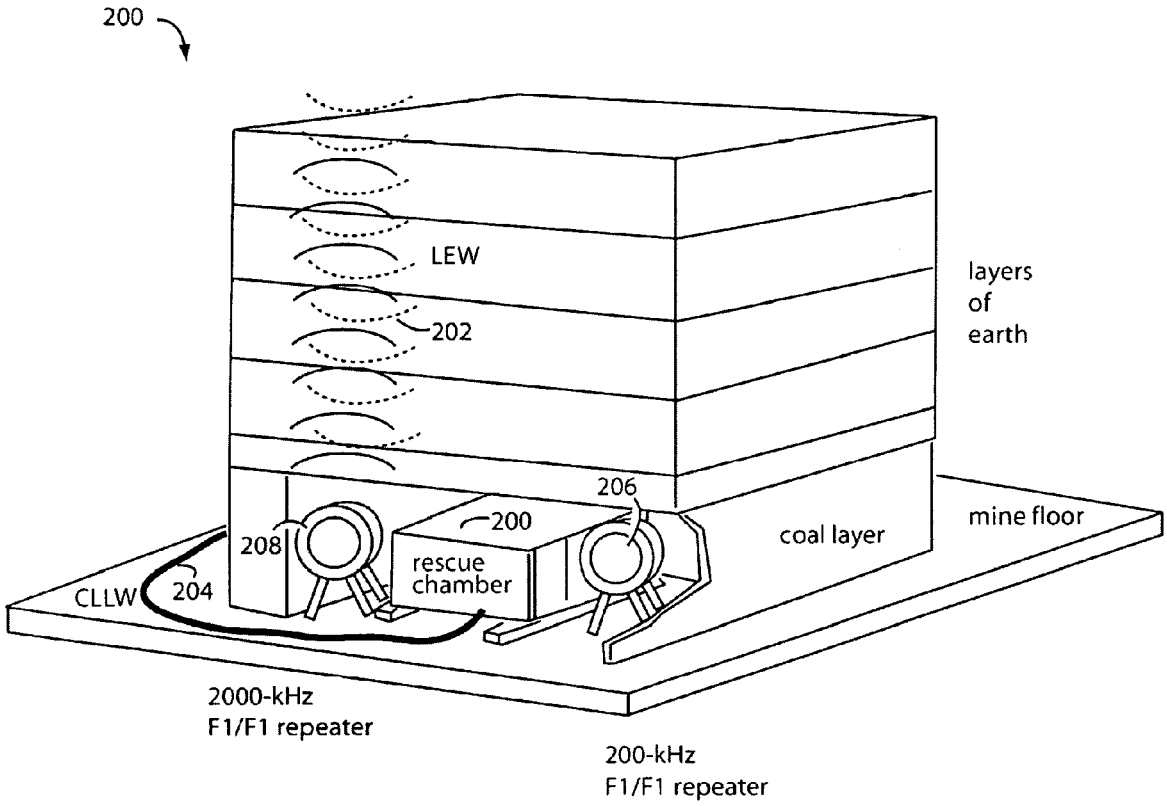
FIG. 2 is a diagram of a refuge chamber equipped with layered earth and conductor lifeline waveguide transmission facilities.
Figure 3:
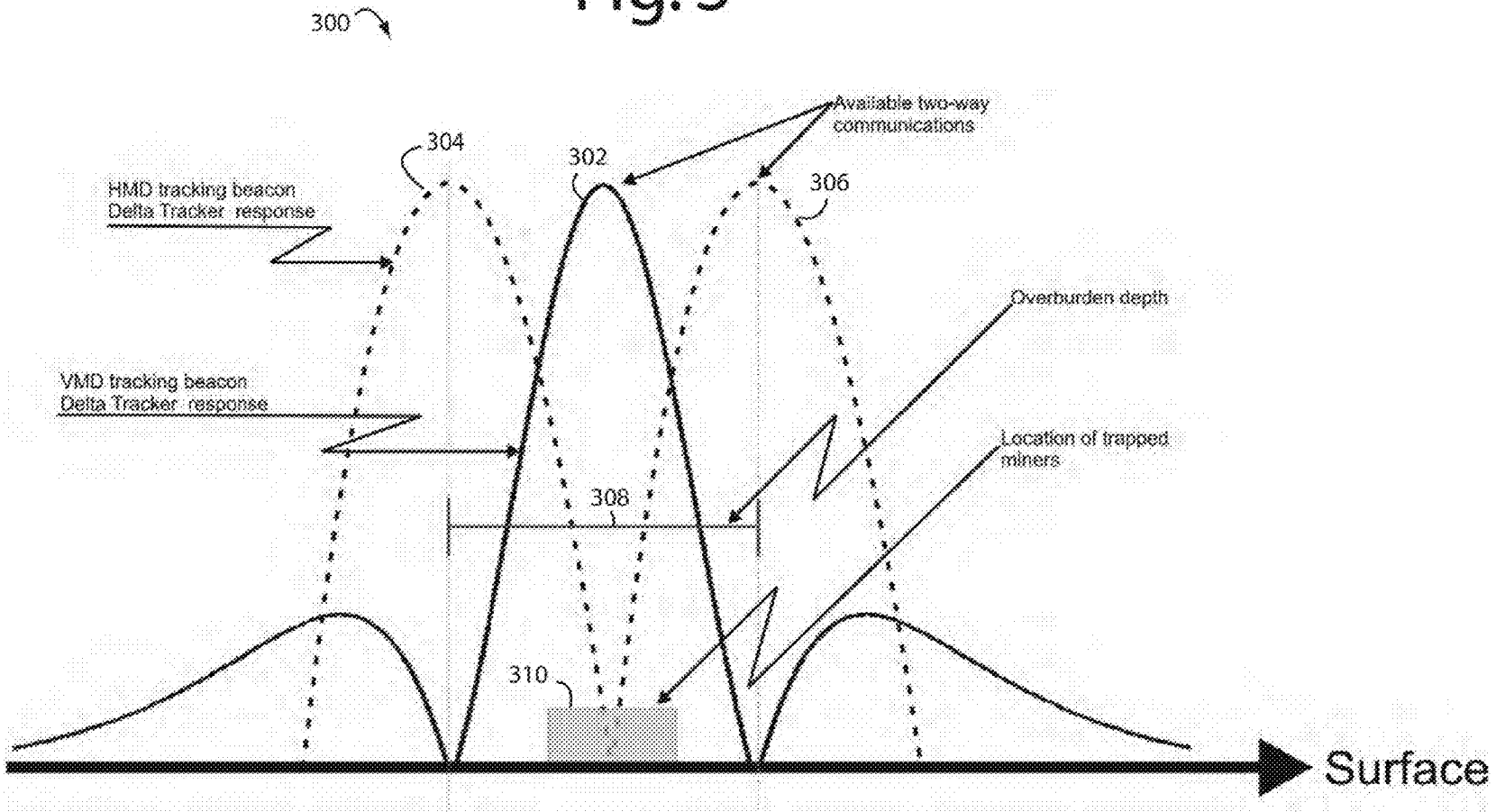
FIG. 3 is a graph representing how signals from miners underground appear at the surface to a Delta Tracker EM Gradiometer.

The electric and magnetic fields is mathematically represented by sinusoidal waveforms that shift in phase by 360 electrical degrees when traveling a distance of one wavelength. The fields illustrated in FIG. 1-3 are detected with receiving antennas. A short vertical electrical conductor is called an electric dipole (VEI) and reproduce an electromotive force (EMF) voltage waveform similar to the electric field waveform mathematically expressed as, $$\text{emf}=h_{ef}E=M\cos\omega t, \tag{1-2}$$

where, $h_{ef}$=the effective height of the antenna,

E=the amplitude of the electric field in volts per meter,

M=the magnitude of the sine wave signal, $\omega=2\pi f$ and f is the frequency in Hertz, and t=the continuing time.

A small coil of wire, a magnetic dipole, can produce an EMF voltage waveform similar to a magnetic field expressed as, $$\text{emf}=i\omega N\mu AH\sin(\omega t)=M\sin(\omega t), \tag{1-3}$$

where, N=the number of turns in the coil, $i=\sqrt{-1}$

A=area of the coil in square meters $\mu=\mu_r\mu_o$ is the magnetic permeability and $\mu_o=4\mu\times10^{-7}$ farads per meter, and H=the amplitude of the magnetic field in amperes per meter.

If the receiving antennas are stationary, the output voltage be continuous sine or cosine waveforms. If the antennas are moved a distance (d) from their original locations to new locations, the waveforms produced can be mathematically represented by, $$\text{emf}=M\cos[\omega t+\theta], \tag{1-4}$$

where, $$\theta = d\left(\frac{2\pi}{\lambda}\right)$$

is the phase shift (e.g., rotation angle) in radians. The number of times per second that the field components complete a 360 degree cycle is called frequency.

A Schumann resonance occurs when lightning energy travels around the world one wavelength back to its original strike location. The one wavelength travel distance phase shift is 360-degrees, reinforcing the wave with frequency components near 14-Hz and referred to as resonance. The occupied frequency band extends upward in frequency, but decaying in amplitude with increasing frequency and spreading of energy in the wavefront.

A symbol T is used to represent the discharge time of the lightning strike. The Fourier transform of the lightning strike time domain pulse results in a frequency domain minimums at 1/T intervals. A half millisecond long lightning strike produces nulls at 2,000-Hz. The sequence of null occurs at multiples of 1/T frequencies.

Periodic lightning strikes occurring around the world, as well as local radio frequency interference (RFI), generate ionosphere-earth waveguide RFI noise (N) with the occupied bandwidth extending well into the higher band. The orientation of the horizontal field components depends upon the world wide distribution of lightning discharge. The polarization varies with time and seasonal change.

A minimum in the measured RFI noise spectrum has been observed in data acquired in Alaska and the lower 48 states. The spectrum near underground mines includes three phase power transmission harmonics. Unbalanced current flow in the electric power three phase distribution cable, along with potential differences between the conductors and the earth surface (also occurring in the roof/floor of the coal bed) cause current flow with harmonics of the power distribution frequency. Current flow is aligned with the distribution conductors to a depth of one skin depth. The orthogonal component is orthogonal to the power line conductors The RFI noise frequency of 360-Hz is very significant in the above surface measurement and found to be exceedingly strong in underground mine power systems. In addition to the strong 360-Hz RFI generated in the underground mine electrical power system, the induction motor slip frequency at frequencies below 1800-Hz are evident in RFI spectrum analysis. Mines employ ground conductor monitoring systems that operate near 4-kHz. These frequencies must be avoided in through the earth communications system design.

The magnetic field noise spectral density has been measured with an envelope between $10^{-4}$ to $8\times10^{-6}$ nano-tesla (nT) per square root Hertz. Taking the average noise in the 0.8 to 3-kHz band, then $10^{-5}$ nT/$\sqrt{\text{Hz}}$ specify the RFI noise density expected on the surface above the trapped miner.

An up-link through-the-earth electromagnetic wave from any trapped miner must be much greater than the (RFI) noise spectrum. The destination signal (S) to noise (N) ratio (SNR) must be greater than, $$\text{dB}=20\log_{10}\text{SNR} \tag{1-5}$$

e.g., 20-dB for intelligible transmission.

RFI noise magnetic field density (B=μH) is the magnetic flux lines per square meter (one tesla equals one Weber per square meter) the magnetic field density exhibits a local minimum in the ULF band (300 to 3000-Hz) near 2000-Hz. If the RFI noise was the only consideration, then TTE communications system operations frequency should be near 2000-Hz. But because the transmission loss through the earth surface boundary decreases with increasing frequency while the absorption (attenuation) loss decreases with frequency, the selection of the optimum operation frequency requires further analysis.

The magnitude of magnetic field density (B) increases with the square root of the receiver detection bandwidth (BW). Transmission of information requires modulation of the electromagnetic wave signal (S). The occupied bandwidth of modulated signal must be constrained to be within the transmission bandwidth of magnetic dipole antennas. Efficient magnetic dipole antennas designs are resonate structures. The operating quality factor (Q) of the magnetic dipole can be mathematically described by, $$Q = \frac{\text{peak energy stored}}{\text{energy dissipated per cycle}} = \frac{f_o}{BW} \tag{1-6}$$

where $f_o$=the resonate frequency and

BW=the circuit 3-dB bandwidth.

An efficient antenna design can minimize the energy dissipated in an antenna structure, and implies minimizing the bandwidth (BW)of the modulated signal carrying the information. A compromise must be between antenna efficiency and bit rate since the transmission bit rate depends on the resonate circuit BW.

High production mining machines require broadband transmission facilities to support remote control and monitoring. Control functions are much faster than an experienced machine operator can react or keep up with mobile equipment. When section or mine wide electric power is switched off following an event, the wide bandwidth transmission facility is not needed and be allowed to go down.

Narrow bandwidth emergency and wide bandwidth operational communications and tracking systems are more likely to be maintained if they are combined into a single system. A conductor/lifeline facility can be used to support narrowband tracking, environmental monitoring, and all voice and text messaging by including a multi-fiberoptic core into the conductor/lifeline waveguide. A narrow and wideband transmission facility is created.

A Yellow-CAT-1 lifeline waveguide cable without a fiberoptic cable is installed in all entries, with the possible exception of man and material (M&M) entries. A Yellow-CAT-2, with a fiberoptic cable, is installed in the M&M entries. The insulated pair of copper conductors provides electric power for transmission and monitoring equipment located in fresh air entries.

A inductor $Q_u$ must be maximized in the design of the magnetic dipole antennas. Often times the unload inductor $Q_u$ must be greater than 200, and $\omega_o$=2 πf the radian frequency and $f_o$ is the resonate frequency. The circuit $Q_{ckt}$ can be mathematically described by, $$Q_{CKT} = \frac{\omega_o L}{R_c + R_s} \tag{1-7}$$

where $R_s$=the source internal resistance.

The $Q_{ckt}$ ranges between 20 (ULF band) and 50 (LF band). The series resonance condition is created by adding capacitance (C) in series with the inductor such that the capacitive reactance $X_c=1/\omega c$ is equal to the inductive reactance $X_L=\omega L$ as, $$X_c = X_L \tag{1-8}$$

$$\frac{1}{\omega C} = \omega L \tag{1-9}$$

then $$\omega_o^2 = \frac{1}{Lc} \text{ and } f_o = \frac{1}{2\pi\sqrt{Lc}} \text{ Hertz.} \tag{1-10}$$

The unloaded $Q_u$ can be mathematically described by, $$Q_n = \frac{\omega_o L}{R_c} \tag{1-11}$$

where $R_c$ is the equivalent series resistance of the antenna coil L is its inductance in henries.

TABLE 1-1

Ionosphere-Earth Waveguide ULF RFI Noise Density (B) and Intensity (H) For Q = 20 Operating Frequency in Hertz

| | 300 | 500 | 1000 | 1500 | 2000 |
|---|---|---|---|---|---|
| Bandwidth (BW) Hertz | 15 | 25 | 50 | 75 | 100 |
| Bit Rate bits per second | 12 | 20 | 40 | 65 | 80 |
| Magnetic Field | | | | | |
| RFI Density (B) picotesla | $1.9 \times 10^{-1}$ | $2.5 \times 10^{-1}$ | $7 \times 10^{-2}$ | $6.9 \times 10^{-2}$ | $8 \times 10^{-2}$ |
| RFI Intensity (H) dB re A/m | −136 | 134 | −145 | −145 | −144 |

The signals propagating to the surface from a trapped miner must be much larger then the surface RFI noise. The destination signal to noise ratio and the modulation detection process determines the destination bit error rate (BER).

For emergency communications, a destination bit error rate can be greater than $10^{-6}$. Variations in lightning strike discharge times cause the null frequency band to vary requiring another means of suppressing the surface RFI problem. Propagating EM waves that make up the RFI come from distant sources and exhibit plane wavefronts when arriving at the surface receiver. Those from buried EM sources, such as scattering from tunnel electrical conductors or from buried vertical and horizontal magnetic dipoles (beacon carried by roaming miners), exhibit spherical spending wave fronts. The gradient of a plane wavefront EM wave is zero while that of a spherical wavefront signal has finite value. The plane wave front surface RFI noise is suppressed by a differential connection of magnetic dipole antennas with a companion receiver and electromagnetic (EM) gradiometer receiver. For more on EM Gradiometers, see, United States Patent Application, 2007/0035304, published Feb. 15, 2007.

The DeltaEM-Gradiometer marketed by Stolar Research Corp. (Raton, N.Mex.) is a commercial type EM-Gradiometer which uses magnetic gradiometry to detect surface and subsurface anomalies, such as coal seams and abandoned mines. Spatial gradients of the magnetic field contain important information about local geological features, both man-made and naturally formed. The gradiometer can measure both total magnetic fields and gradients of the magnetic field.

The DeltaEM-Gradiometer's electronic design enables synchronization between the primary field components, which allows the equipment to detect the smallest possible secondary signal in electrical noise. Gradient antennas with a coherent receiver obtain inherently high sensitivity for the detection range of shallow-buried to deep-buried anomalies. A global positioning system (GPS) receiver and a radio frequency (RF) modem are integrated into the gradiometer. The gradiometer sensor data are time and position stamped with information from the GPS. The RF modem allows wireless communication with the gradiometer receiver. The use of multiple frequency operation enhances the detection of small-size anomalies. The entire system is non-intrusive and operates on rechargeable batteries.

Detection in real time with calculated burial depth and location of the anomaly are key parameters in this high-performance system. The instrumentation can be hand carried, mounted on a vehicle, such as an all-terrain vehicle, or mounted on an unmanned aircraft or a helicopter.

In mining, the DeltaEM-Gradiometer system can be used to detect the surface signatures of underground carbonaceous reserves and detect and map underground voids, such as sink holes and pockets of air and water. The system has other applications as well. These include commercial and industrial utility-line mapping, inspecting dams and other water impoundments to ensure their integrity and surface tracking of deeply buried beacon transmitters in search and rescue situations.

Various methods have been developed to detect through the earth (TTE) Transmission/Reception signals deeply embedded in noise. They involve auto correlation, convolution, cancellation or processing suppression. Synchronization with RFI source is required with these methods. A US Bureau of Mines (USBM) project employing PN code in a self synchronization scheme achieved TTE communication at very low data rate communications.

Researchers have developed a 60-Hz power line synchronization method called the "turtle" to achieve low data rate communication in auto correlation detection. This technology is used to remotely read power meters by sending data at the zero crossings of the power distribution system. Both electric and magnetic filed reception of the primary RFI waveform (noise) have been used in synchronization of homodyne and super heterodyne receivers to achieve detection bandwidth of less than one Hertz. One such system was developed for 2000-Hz detection of underground tunnels in the High Frequency Active Aurora Research Project (HAARP) where an EM-Gradiometer achieved buried tunnel detection 100 miles down range at the Delta mine site in Alaska. The HAARP phased array transmitter heats the Aurora Borealis electron jet by turning the 750 kilowatt transmitter on and off at the 2000-Hz rate. The 2000-Hz electron jet current is the source of the primary plane wave front illuminating the Delta mine tunnel. The HAARP transmitter is being increased to 3 megawatts. One of the problems with designing synchronizing methods that are synchronized with the primary RFI noise is the unintended consequence of also receiving the signal from the trapped miner. The combined RFI noise and TTE signals when applied in cancellation or suppression schemes act to lower the detection SNR. Often times, this problem goes unnoticed in the processing code development.

An EM-Gradiometer can be used on the surface or flying above to detect the signal from a system refuse chamber (200 in FIG. 2) or cap-lamp transceiver 102. It is hand carried on the surface, or flown on an unmanned aerial vehicle (UAV) to pinpoint the location of trapped miners by sensing the origin of the transmitted signal. What it's looking for are any TTE EM waves that travel straight upward through the layered earth.

If the maximum response of an EM-Gradiometer is correlated with global positioning system (GPS) information and mine maps, the miner's location within the mining complex and their depth below the surface can be surmised. EM-Gradiometers are modified to display text messages sent from a tracking beacon sent from a refuse chamber or cap-lamp battery transceiver.

FIG. 2 represents a refuse chamber 200 with layered earth (LEW) 202 and conductor lifeline (CLLW) 204 waveguide transmission facilities. A 200-kHz F1/F1 repeater 206 enables transmission in the conductor/lifeline waveguide (CLLW) 109. Another, 2000-Hz F1/F1 repeater 208 enables transmission in the layered earth waveguide (LEW) 107. Simplex, half-duplex digital voice transmission is used in both waveguides. A coal seam waveguide (CSW) provides working face coverage, and the LEW waveguide can be used as the last link to the surface for emergency communication.

EM-Gradiometers use two oppositely wound coils to create polarized horizontal magnetic dipoles. These are coaxially separated by a short distance. Upward traveling EM wave magnetic field components are polarized. A surface or airborne gradiometer will see an electromotive force (EMF) generated in each coil. Such EMF can be mathematically represented by, $$\text{emf} = -N\frac{d\phi}{dt}, \tag{1-12}$$

where N=the number of turns of magnetic wire and

Φ=the flux of the magnetic field.

The flux can be mathematically represented by, $$\phi = BA, \tag{1-13}$$

where, B=μH the magnetic field density Webbers per square meter,

H=the magnetic field intensity in amperes per meter, and $\mu=\mu_o\,\mu_r$, where, $\mu_o=4\pi\times10^{-7}$ and $\mu_r$ is the relative magnetic permeability.

Continuous wave (CW) magnetic fields generate electromotive force voltage mathematically expressed by, $$\text{emf}=-iN\mu_o\omega(\mu_r A)H \text{ volts} \tag{1-14}$$

A series connection of the coils generates an output voltage $V=\text{emf}_1-\text{emf}_2$. For every incidence angle, plane wavefronts generate identical EMF values force the differential summation to zero (suppression). The ratio of the magnitudes of the EMF generated in a single antenna coil to the differential sum voltage expressed in logarithms is the suppression factor for the gradiometer. The gradiometer response along a flight or survey path over a trapped miner is illustrated in FIG. 3. EM-Gradiometers suppress the plane wavefront surface RFI noise in the receiving antenna. Surface RFI noise would otherwise severely limit the depth of detection.

FIG. 3 is a graph 300 representing how signals 302, 304, and 306 from miners underground with cap-lamp and beacon transceivers will appear at the surface to a Delta Tracker type EM Gradiometer. Signal 302 is maximum at points directly above when using a vertical magnetic dipole (VMD). Signals 304 and 306 will have maximums observed by a horizontal magnetic dipole (HMD) at a separation distance (D) 308 that varies in proportion to the depth of overburden above, for example, a refuse chamber or cap-lamp transceiver 310. Signals 302, 304, and 306 can be used as carriers to support voice and text communication with the surface.

Refuse chamber and cap-lamp transceivers operating in the TTE ultra low frequency (ULF) band use a horizontal magnetic dipole (HMD) antenna to generate a magnetic field. If the seam depth is less than one skin depth (s), a vertical magnetic dipole (VMD) is used. Otherwise, a horizontal magnetic dipole (HMD) is preferred.

FIG. 3 shows what happens when an EM-Gradiometer is moved or flown over the surface areas that are directly vertical from a trapped miner. A characteristic peak and null in the gradiometer response occurs exactly over the location of a radiating magnetic dipole antenna. The peak-to-peak (HMD) or null-to-null (VMD) separation distance can be used to estimate the depth of burial. But, any refractions occurring near the surface can lead to errors in the depth estimates.

A quick airborne detection of a trapped miner is made possible in embodiments of the present invention. An EM-Gradiometer payload on an unmanned aerial vehicle (UAV) is flown over the mine site. UAV navigation is handed off to a Situation Awareness Computer System (SACS) at the mine. The SACS is preprogrammed to control the UAV search pattern with a flight duration limited to twenty (20) hours. Trapped miner detection training is periodically conducted by MSHA at the mine site. The SACS terrain map provides automatic flight control information to the UAV auto pilot, the location is quickly determined. A hand-held EM-Gradiometer is directed to the location directly above where the trapped miner is expected to be.

The radio communications and tracking system design requirements for emergency and operational conditions in underground mines are vastly different from those imposed in the standard telecommunications industry. Specifically, the design requirements and existing data transmission protocol cannot be applied. The underground system design is first and foremost based on radio geophysics fundamentals. The absorption (attenuation) of EM energy along transmission paths is significant when compared with the attenuation rates encountered in terrestrial and satellite communications networks. Because attenuation rates are significant, the design must focus on maximizing receiver (detection) sensitivity.

When considering transmission in a coal mine, the intrinsic safety limitations restrict energy release from batteries and reactive circuit components to less than 0.25 millijoule. This limits transmit power and forces the receiver to be optimized for maximum detection sensitivity. The destination signal to noise ratio must be greater than 20-dB to achieve acceptable bit error rate for intelligible communications. The destination signal (S) arriving at each receiver must be significantly greater than the noise (N). As the SNR degrades, the intelligibility of the message becomes unacceptable. The system design must minimize the RFI noise as well as the noise generated in the receiver input circuits for through-the-earth communicating. Methods of combating RFI employing gradiometer methods were presented in the preceding paragraphs. The receiver design itself must minimize noise for maximum detection sensitivity.

A receiver's detection sensitivity can be mathematically represented by, $$S_T^{10} = -164 + 10\log_{10} BW + 10\log_{10} NF \text{ dBm} \quad (1\text{-}15)$$

where, BW is the noise bandwidth of the receiver in hertz, and

NF is the noise figure of the receiver.

The received signal $S_T^{10}$ produces a 10-dB SNR in the receiver signal path. The first right-hand term (−164-dBm) represents a signal of 1.41 nano-volts that produces a SNR of 10-dB in the receiver signal path. The far right-hand term represents the threshold detection sensitivity degradation due to receiver noise figure. Typically, a well-designed receiver exhibit a noise figure near 2-dB. The middle term shows that the noise bandwidth (BW) is the predominating factor in the receiver design problem. Radio Geophysics requires the understanding of the above equation. Modulation processes that require wide occupied bandwidth significantly degrade detection sensitivity. Increasing the detection bandwidth by a factor of ten, requires an increase in transmit power by a factor of ten when compared to a companion receiver design optimized for minimum occupied bandwidth detection. A 10-watt transmitter would need to be increased to 100-watts if the detection bandwidth was increased from 300-Hz to 3,000-Hz. But a 100-watt transmitter can not be made intrinsically safe.

Figure 4:
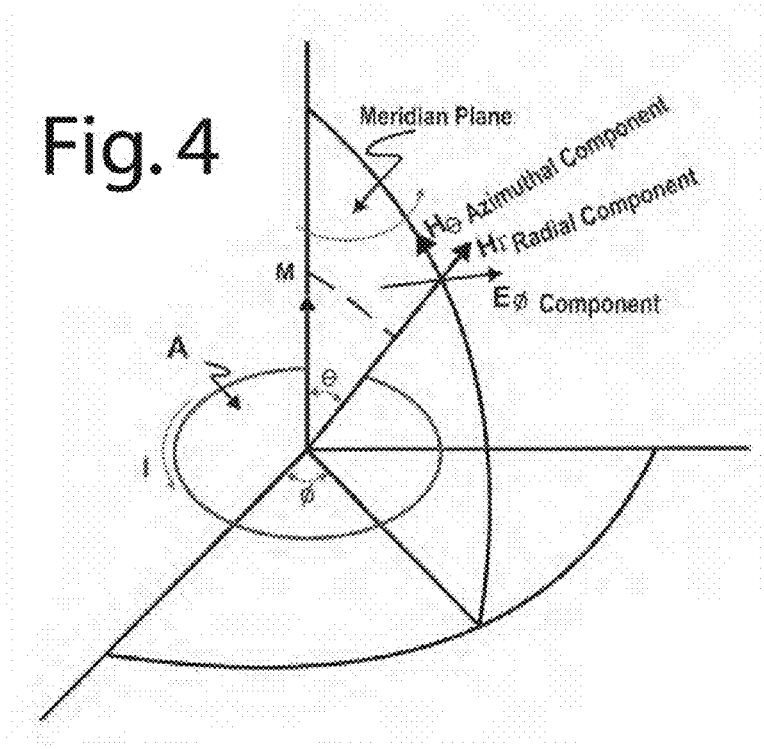
FIG. 4 is a 3D graph representing the electric and magnetic field components radiating from an oscillating magnetic dipole.

FIG. 4 represents the electric and magnetic field components radiating from an oscillating magnetic dipole. The magnetic moment (M) vector can be mathematically represented by, $$M = NIA \text{ ampere turn meter}^2, \quad (1\text{-}16)$$

Where N=the number of turns in the loop antenna,

I=the peak current flowing in the antenna in amperes, and

A=a vector normal to the loop with a magnitude equal to the loop area in square meters.

The dipole source current I and the magnetic moment vary as $e^{ion}$. The time factor $e^{ion}$ implied throughout the following discussions. The definition of circuit Q of a resonant loop antenna is used to show that the magnitude of the magnetic moment can be mathematically represented by, $$M \propto \sqrt{\frac{p_d}{BW}} \text{ amperes turn meter}^2, \quad (1\text{-}17)$$

where, $P_d$=the power dissipated in the resonant loop antenna structure and

BW=the 3-dB bandwidth of the antenna circuit.

The spherical coordinate system (r, θ, φ) is used to describe the general orientation of the field components. When the physical dimension of the loop is small relative to the wavelength (λ), the magnetic dipole field components may be described as (Bartel and Cress 1997, Bollen 1989)

Azimuthal (θ) component in amperes per meter $$H_\theta = \frac{Mk^3}{4\pi}\left[\frac{1}{(kr)^3} + \frac{i}{(kr)^2} - \frac{1}{(kr)}\right]e^{-ikr}\sin\theta, \quad (1\text{-}18)$$

Radial (r) component in amperes per meter $$H_r = \frac{Mk^3}{2\pi}\left[\frac{1}{(kr)^3} + \frac{i}{(kr)^2}\right]e^{-ikr}\cos\theta, \text{ and} \quad (1\text{-}19)$$

Longitudinal (φ) component in volts per meter $$E_\phi = \frac{i\mu\omega Mk^2}{4\pi}\left[\frac{-1}{(kr)^2} + \frac{1}{i(kr)}\right]e^{-ikr}\sin\theta. \quad (1\text{-}20)$$

where, $\omega = 2\pi f_o$ and $f_o$ is the operating frequency in hertz, $i = \sqrt{-1}$, r=the radial distance from the radiating antenna in meters, and $k = \beta - i\alpha$, is the propagation factor with β being the phase constant in radians per meter and α the attenuation rate in nepers per meter.

The magnetic field vectors lie in the meridian plane. The electric vector ($E_{100}$) is perpendicular to the meridian plane and subscribes concentric circles around the z axis magnetic dipole moment vector. The terms in the field component equations have been arranged in the inverse power of r (Equations 1-13 to 1-15). The radial distance $r = \lambda/2\pi$ defines a particular spherical surface surrounding the dipole antenna. The static and induction components predominate inside the sphere while the far-field radiation components predominate outside the sphere. The radiation far-field fields are given by, $$H_\theta = \left[\frac{-Mk^2}{4\pi}\right]\frac{e^{-ikr}}{r}\sin\theta, \text{ and} \quad (1\text{-}21)$$

$$E_\phi = \left[\frac{\mu\omega Mk}{4\pi}\right]\frac{e^{-ikr}}{r}\sin\theta \text{ volts per meter.} \quad (1\text{-}22)$$

The radiation fields are transverse (e.g., orthogonal), which is expected of wave propagation at great distances from all electromagnetic wave sources. The sine θ and cosine θ terms describe the antenna pattern for the dipole fields.

The fields of infinitesimal magnetic and electric dipole embedded in infinite homogenous medium of electrical constants; conductivity σ, magnetic permeability μ and dielectric constant (E) is expressed in terms of the propagation constants: attenuation rate (α) (nepers per meter) and phase constant (β) (radians per meter) as Magnetic Dipole $$H_\theta = \frac{M}{4\pi r^3}\left\{\left[\left(\left(\frac{\alpha}{\beta}\right) + \frac{1}{\beta r} - \beta r + \left(\frac{\alpha}{\beta}\right)^2\beta r\right) + i\left(1 + 2\left(\frac{\alpha}{\beta}\right)\beta r\right)\right](\beta r)e^{-\left(\frac{\alpha}{\beta}\right)\beta r}\right\}e^{-i\beta r}\sin\theta \quad (1\text{-}23)$$

$$\text{and } H_\theta = (m/4\pi r^3)Ae^{-i\phi_1} \quad (1\text{-}24)$$

$$H_r = \frac{M}{2Mr^2}\left\{\left[\left(\left(\frac{\alpha}{\beta}\right) + \frac{1}{\beta r}\right) + i\right](\beta r)e^{-\left(\frac{\alpha}{\beta}\right)\beta r}\right\}e^{-i\beta r}\cos\theta \quad (1\text{-}25)$$

$$\text{and } H_r = (M/2\pi r^2)Be^{-i\phi_2} \quad (1\text{-}26)$$

-continued $$E_\phi = \frac{M}{4\pi r^3}(-i\omega\mu)\left\{\left[\left(\frac{\alpha}{\beta}\right) + \frac{1}{\beta r} + i\right](\beta r)e^{-\left(\frac{\alpha}{\beta}\right)}\right\}e^{-i\beta r}\sin\theta \tag{1-27}$$

$$\text{and } E_\phi = (M/4\pi r^3)(-i\omega\mu)Be^{-i\phi_2} \tag{1-28}$$

Electric Dipole $$E_\theta = \frac{Idl}{4\pi r^3}\left(\frac{1}{\sigma}\right)\left\{\left[\left(\left(\frac{\alpha}{\beta}\right) + \frac{1}{\beta r} - \beta r + \left(\frac{\alpha}{\beta}\right)^2\beta r\right) + i\left(1 + 2\left(\frac{\alpha}{\beta}\right)\beta r\right)\right](\beta r)e^{-\left(\frac{\alpha}{\beta}\right)r}\right\}e^{-i\beta r}\sin\theta \tag{1-29}$$

$$\text{and } E_\theta = (Idl/4\pi r^3)(1/\sigma)Ae_1^{i\phi} \tag{1-30}$$

$$E_r = \frac{Idl}{2\pi r^3}\left(\frac{1}{\sigma}\right)\left\{\left[\left(\left(\frac{\alpha}{\beta}\right) + \frac{1}{\beta r}\right) + i\right](\beta r)e^{-\left(\frac{\alpha}{\beta}\right)\beta r}\right\}e^{-i\beta r}\cos\theta \tag{1-31}$$

$$E_r = (Idl/2\pi r^3)(1/\sigma))Be^{-8i\theta_2} \tag{1-32}$$

$$H_\phi = \frac{Idl}{4\pi r^2}\left\{\left[\left(\frac{\alpha}{\beta}\right) + \frac{1}{\beta r} + i\right](\beta r)e^{-\left(\frac{\alpha}{\beta}\right)\beta r}\right\}e^{-i\beta r}\sin\theta \tag{1-33}$$

$$\text{and } H_\phi = (Idl/4\pi r^2)Be^{-i\phi_2} \tag{1-34}$$

Each field has been separated into the magnetic ($M/4\pi r^3$ or $M/2\pi r^2$) or current ($Idl/4\pi r^2$ or $Idl/2\pi r^2$)excitation/spatial term and the geologic terms (A and B).

The magnitude of the azimuthal magnetic field component $H_\Phi$ is expressed in terms of the propagation factor ratio $\alpha/\beta$ and the space scaling factor $\beta r$ as, $$|H_\theta| = \frac{M}{4\pi r^3}\left[\beta r e^{-\left(\frac{\alpha}{\beta}\right)\beta r}\right]\left\{\left[\frac{1}{\beta r} - \beta r + \left(\frac{\alpha}{\beta}\right) + \left(\frac{\alpha}{\beta}\right)^2\beta r\right]^2 + \left[1 + 2\left(\frac{\alpha}{\beta}\right)\beta r\right]^2\right\}^{\frac{1}{2}} \tag{1-35}$$

and phase by, $$\phi_1 = -\beta r + \mathrm{Tan}^{-1}\left[\frac{1 + 2\left(\frac{\alpha}{\beta}\right)\beta r}{\frac{1}{\beta r} - \beta r + \left(\frac{\alpha}{\beta}\right)^2\beta r + \left(\frac{\alpha}{\beta}\right)}\right] \tag{1-36}$$

The intensity of electric field $$1E_\phi 1 = \frac{M}{4\pi r^3}(\omega\mu)\left\{\left[\left(\frac{\alpha}{\beta}\right) + \frac{1}{\beta r}\right]^2 + 1\right\}^{\frac{1}{2}} \tag{1-37}$$

$$\text{and } \phi_2 = \beta r + \mathrm{Tan}^{-1}\left[\frac{1}{\frac{\alpha}{\beta} + \frac{1}{\beta r}}\right] \tag{1-38}$$

The magnitude and phase of the component fields depends on the ratio of the propagation factors $$\left(\frac{\alpha}{\beta}\right)$$

and the geologic space scaling factor ($\beta r$). The ratio of propagation factor $$0 \le \frac{\alpha}{\beta} \le 1.$$

The curve labeled $\alpha/\beta=0$ and $\alpha/\beta=1$ represent propagation through free space and slightly conducting natural media; respectively. Heaviside's wave propagation constants are given by, $$\alpha = \omega\left[\frac{\mu\varepsilon}{2}\left(\left[1 + \left(\frac{\sigma}{\varepsilon\omega}\right)^2\right]^{\frac{1}{2}} - 1\right)\right]^{\frac{1}{2}} \text{ nepers per meter and} \tag{1-39}$$

$$\beta = \omega\left[\frac{\mu\varepsilon}{2}\left(\left[1 + \left(\frac{\sigma}{\varepsilon\omega}\right)^2\right]^{\frac{1}{2}} + 1\right)\right]^{\frac{1}{2}} \text{ radians per meter,} \tag{1-40}$$

where, $\sigma$=the electrical conductivity in Siemens per meter, $\in=\in_r\in_o$ is the permittivity of the medium, the free space permittivity ($\in_o$) is $1/36\pi\times10^{-9}$, and $\in_r$ is the relative dielectric constant, and $\mu=\mu_r\mu_0$ is the magnetic permeability, the permeability of free space $\mu_0=4\pi\times10^{-7}$, and $\mu_r$ is the relative permeability and $\mu_r$ is the relative permeability.

The velocity (v) can be mathematically represented by, $$v = \frac{\omega}{\beta} \text{ in meters per second} \tag{1-41}$$

When the loss tangent given by $\sigma/\omega\in$ is much, much greater than unity $$\left(\frac{\sigma}{\omega\varepsilon} >> 1\right),$$

the attenuation rate ($\alpha$) and the phase constant ($\beta$) are both given by, $$\alpha = \beta = \sqrt{\frac{\omega\mu\sigma}{2}}. \quad (1\text{-}42)$$

This condition implies that the conduction current exceeds the displacement current in the medium.

The magnitude of the EM wave changes by approximately 55-dB for each wavelength traveled in the medium. Equation 37 suggests that the propagation constants are relatively independent of the media dielectric constant in the limit $\sigma/\omega\in>>1$.

When the displacement current predominates in the medium ($\sigma/\omega\in<<1$), the attenuation and phase constants become, respectively, $$\alpha = \frac{\sigma}{2}\sqrt{\frac{\mu}{\varepsilon}} \text{ and } \beta = \omega\sqrt{\mu\varepsilon}. \quad (1\text{-}43)$$

The attenuation constant a is dependent upon both $\sigma$ and $\in_r$ and is explicitly independent of frequency; however, $\in_r$ and $\sigma$ may be dependent on frequency.

The velocity from Equation 1-36 becomes $$\upsilon = \frac{c}{\sqrt{e_r}};\ \frac{\sigma}{wE} << 1 \quad (1\text{-}44)$$

The EM wave propagation constants have been evaluated over a wide range of frequencies and electrical parameters. The propagation constants is determined for the estimated conductivity prevailing in a given medium.

The wavelength in any medium can be mathematically represented by, $$\lambda = \frac{2\pi}{\beta} \text{ meters}, \quad (1\text{-}45)$$

where the wavelength is the distance traveled by the EM wave in the medium that results in $2\pi$ radians of phase shift.

The wavelength also can be mathematically represented by, $$\lambda = \frac{\upsilon}{f},\ \frac{\sigma}{\omega\varepsilon} << 1 \quad (1\text{-}46)$$

The skin depth ($\delta$), which is distance traveled in the medium that results in a 8.686-dB change in attenuation, can be mathematically represented by, $$\delta = \frac{l}{\alpha} \text{ meters}, \quad (1\text{-}47)$$

The significance of the loss tangent $\sigma/\omega\in$ is seen in Maxwell's first equation, given as $$\nabla \times H = \varepsilon^* \frac{\partial E}{\partial t}, \quad (1\text{-}48)$$

where the rotating electric field component is represented by, $$E = E_o e^{+i\omega t}, \quad (1\text{-}49)$$

and $E_o$ is the magnitude of electric field.

Because of the complex nature of the dielectric constant in natural media, the dielectric constant can be mathematically represented by, $$\in^* = \in' - i\in'', \quad (1\text{-}50)$$

where $\in'$ is the real part and $\in''$ is the imaginary part. Maxwell's first equation becomes $$\nabla \times H = \in''\omega E + i\in'\omega E. \quad (1\text{-}51)$$

The first term on the right-hand side of Equation 1-46 represents the conduction current ($I_c$) flow induced in the medium ($I_c = \in''\omega E$; Ohm's law). The second term is the displacement current flowing in the medium. The electrical conductivity can be mathematically represented by, $$\sigma = \in''\omega \text{ Siemens per meter.} \quad (1\text{-}52)$$

The electrical conductivity of the natural media increases with the first power of frequency ($\omega$). The attenuation rate increases with the first power of frequency.

$$\alpha = \omega\sqrt{\frac{\varepsilon''\mu}{2}} \text{ in nepers per minute.} \quad (1\text{-}53)$$

Figure 5:
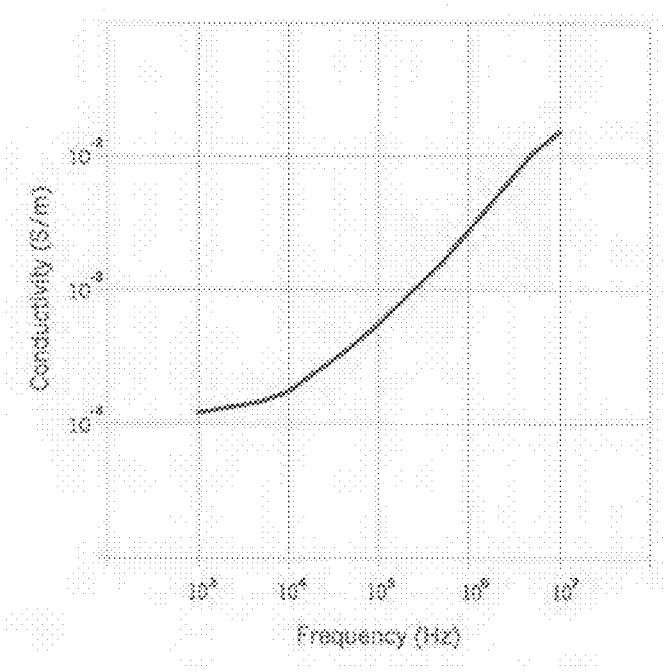
FIG. 5 is a graph of the electrical conductivity ($\sigma$) of sedimentary rocks as measured in a laboratory and shows a first-order dependence on frequency, in Siemens per meter versus frequency.

Referring now to FIG. 5, the electrical conductivity ($\sigma$) of sedimentary rocks has been measured in Stolar's laboratory and shows a first-order dependence on frequency, in Siemens per meter versus frequency. The electrical conductivity is frequency dependent because of the complex nature of the natural media dielectric constant. The second term on the right side of Equation 1-46 represents the displacement current flowing in the media. The loss tangent, $\sigma/\omega\in$, is the ratio of conduction to displacement current.

Figure 6:
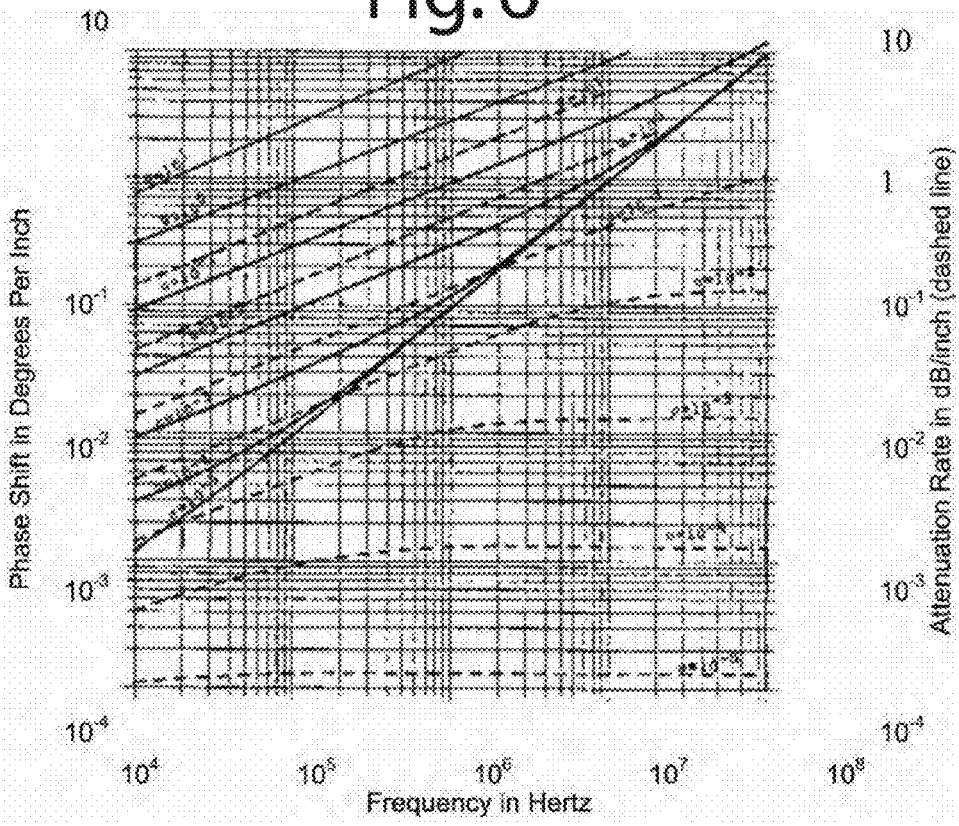
FIG. 6 represents the attenuation rate ($\alpha$) and phase shift ($\beta$) values in graphical form.

FIG. 6 represents the attenuation rate ($\alpha$) and phase shift ($\beta$) values in graphical form.

Figure 7:
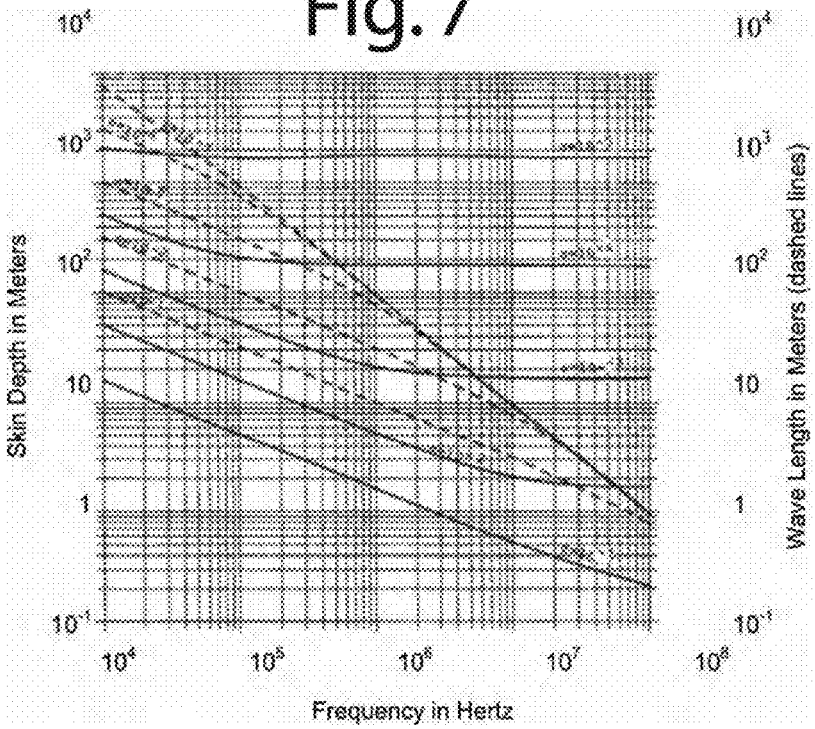
FIG. 7 represents the skin depth and wavelength of subsurface EM waves.

FIG. 7 represents the skin depth and wavelength of subsurface EM waves. In FIG. 6, the attenuation rate ($\alpha$) and phase constant ($\beta$) for a Uniform Plane Wave Propagating in a Natural Medium with a Relative Dielectric Constant of ten. Bottom-to-Top Curves Represent Increases in Natural Media Conductivity From $10^{-5}$ to $10^{1}$ S/m. In FIG. 7, Skin Depth and Wavelength in a Natural Medium with a Relative Dielectric Constant of 10.

Figure 8:
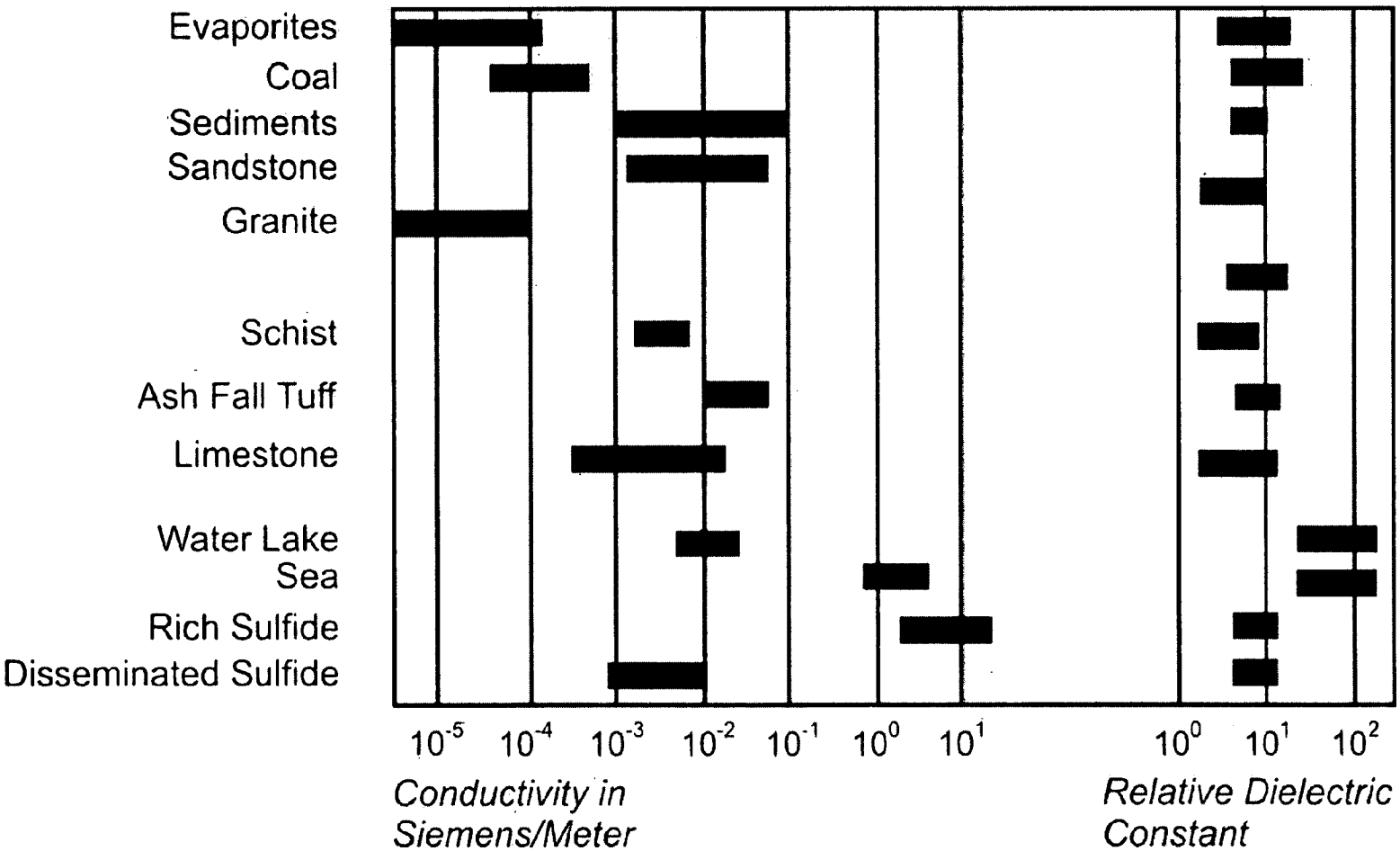
FIG. 8 is a graph showing the range of electrical conductivity and relative dielectric constant for natural media, in which the propagation constant can be estimated for various types of natural media.

FIG. 8 shows the range of electrical conductivity and relative dielectric constant for natural media, whereby the propagation constant can be estimated for various types of natural media.

The electrical conductivity of most natural media increases with frequency. The left end of the bar symbol in FIG. 1-16 corresponds to low frequency values. FIG. 1-14 shows that the lower frequency signal attenuation rate decreases from high frequency values so that deeper targets are detected at lower frequencies.

Tables 1-2 and 1-3 are lists of the EM wave propagation parameters for a wide range of natural media. Table 1-1 assumes a relative dielectric constant of 4. The electrical parameters for coal, shale, lake water, limestone, and air are given in Table 1-2. Table 1-2 assumes values often given in petrophysics articles.

TABLE 1-2

Electromagnetic Wave Transmission Parameter

| Frequency (MHz) | Loss Tangent | Attenuation Rate (dB/ft) | Phase Constant (Rad/m) | Wavelength (=2 * π/β) (m) | Wave-length (ft) |
|---|---|---|---|---|---|
| | | $\sigma = 0.0005$ S/m $\epsilon_r = 4$ | | | |
| 1 | 2.25 | 0.09 | 0.06 | 113.97 | 373.93 |
| 3 | 0.75 | 0.12 | 0.13 | 47.11 | 154.58 |
| 10 | 0.22 | 0.12 | 0.42 | 14.90 | 48.88 |
| 30 | 0.07 | 0.12 | 1.26 | 4.99 | 16.38 |
| 60 | 0.04 | 0.12 | 2.52 | 2.50 | 8.20 |
| 100 | 0.02 | 0.12 | 4.19 | 1.50 | 4.92 |
| 300 | 0.01 | 0.12 | 12.58 | 0.50 | 1.64 |
| | | $\sigma = 0.005$ S/m $\epsilon_r = 4$ | | | |
| 1 | 22.47 | 0.36 | 0.14 | 43.74 | 143.50 |
| 3 | 7.49 | 0.60 | 0.26 | 24.16 | 79.26 |
| 10 | 2.25 | 0.95 | 0.55 | 11.40 | 37.39 |
| 30 | 0.75 | 1.18 | 1.33 | 4.71 | 15.46 |
| 60 | 0.37 | 1.23 | 2.56 | 2.46 | 8.06 |
| 100 | 0.22 | 1.24 | 4.22 | 1.49 | 4.89 |
| 300 | 0.07 | 1.25 | 12.58 | 0.50 | 1.64 |
| | | $\sigma = 0.05$ S/m $\epsilon_r = 4$ | | | |
| 1 | 224.69 | 1.17 | 0.45 | 14.11 | 46.29 |
| 3 | 74.90 | 2.02 | 0.77 | 8.11 | 26.61 |
| 10 | 22.47 | 3.64 | 1.44 | 4.37 | 14.35 |
| 30 | 7.49 | 6.03 | 2.60 | 2.42 | 7.93 |
| 60 | 3.74 | 7.98 | 3.93 | 1.60 | 5.25 |
| 100 | 2.25 | 9.48 | 5.51 | 1.14 | 3.74 |
| 300 | 0.75 | 11.76 | 13.34 | 0.47 | 1.55 |

TABLE 1-3

Electrical Parameters for Coal, Shale, Lake Water, and Air

| | Electrical Parameter | | Frequency (1 MHz) | | Frequency (100 MHz) | |
|---|---|---|---|---|---|---|
| Surface | $\sigma$ | $\epsilon_r$ | $\frac{\sigma}{\omega\varepsilon}$ | \|Z\| | $\frac{\sigma}{\omega\varepsilon}$ | \|Z\| |
| Dry coal | 0.0005 | 4 | 2.247 | 120.1 | 0.022 | 188.3 |
| Saturated shale | 0.05 | 7 | 128.4 | 12.6 | 1.284 | 111.6 |
| Lake water | 0.02 | 81 | 4.44 | 19.6 | 0.044 | 41.8 |
| Limestone | 0.001 | 9 | 2.00 | 84.0 | 0.020 | 125.6 |
| Air | 0 | 1 | 0 | 376.7 | 0 | 376.7 |

A lot of the energy in EM waves is reflected at the boundaries and interfaces of two electrically different natural media. Only a portion of the energy from the transmitter will actually reach the receiver. Another major portion of the transmitted energy is absorbed in the intervening media and lost as heat.

When the propagating electromagnetic wave intersects a boundary of contrasting electrical parameters (petrophysics), reflections, refraction and scattering occur. For normal incidence the reflection coefficient (Γ) is given mathematically by, $$\Gamma = \frac{E_R}{E_i} = \frac{Z_2 - Z_1}{Z_2 + Z_1}, \tag{1-54}$$

where the impedance of the natural medium can be mathematically represented by, $$Z = \frac{\sqrt{\frac{\mu}{\varepsilon}}}{\sqrt{1 - i\frac{\sigma}{\omega\varepsilon}}}, \tag{1-55}$$

$$|Z_i| = \frac{\sqrt{\frac{\mu}{\varepsilon}}}{\left[1 + \left(\frac{\sigma}{\omega\varepsilon}\right)^2\right]^{\frac{1}{4}}} \tag{1-56}$$

$$Z = \begin{cases} \sqrt{\frac{i\omega\mu}{\sigma}} = \sqrt{\frac{\omega\mu}{\sigma}} \angle 45°; & \frac{\sigma}{\omega\varepsilon} >> 1 \\ \frac{377}{\sqrt{\varepsilon_r}}; & \frac{\sigma}{\omega\varepsilon} << 1 \end{cases}. \tag{1-57}$$

The transmission through the interface can be mathematically represented by, $$T = \frac{2Z}{Z + Z_o}. \tag{1-58}$$

Underground radio communication research, development, and in-mine demonstrations have determined that five different waveguides can be exploited to support electromagnetic (EM) wave transmission in underground mines.

Namely, the EM wave transmission waveguides simultaneously used by embodiments of the present invention are the: Ionosphere-earth surface waveguide; through-the-layered-earth (TTE) waveguide; conductor/lifeline(CLL) waveguide; coal/trona/potash seam (CS) waveguide; and, tunnel waveguide.

A multi-mode radio communications transceiver able to use these five waveguides is provided for miners use in underground mines. The system allows two-way text messaging and voice communications between roaming underground mine personnel.

The through-the-layered-earth waveguide supports ULF (e.g., 300 to 3,000-Hz) band transmission. The ULF band limitation includes the problem of driving high currents in very long wire antennas. Deployment of long wire antennas in mountainous terrain and obtaining permission from surface landowners is a formidable problem. Voice band waveforms cannot be directly communicated by ULF EM waves so that text messaging must be used. The maximum transmission distance is determined primarily by the absorption of EM wave energy when traveling through soil and rock; reflection losses from boundaries (air-earth surface and coal-entry) with high impedance contrast; limits on the detection sensitivity of a receiver; and the magnetic moment of the radiating magnetic dipole.

The absorption of energy can be determined from the attenuation rate. The attenuation rate is primarily determined by the operating frequency and electrical parameters of the soil and rock. The reflection loss is predominately determined by the contrast in electrical parameters at a geologic boundary, which are frequency dependent. The electrical conductivity is strongly dependent on the complex nature of the dielectric constant of soil and rock and increases with frequency. This condition causes the attenuation rate to increase with the first power operating frequency. The detection sensitivity degrades with 10 $\log_{10}$ BW. Narrow bandwidth (BW) transmission facilities are required in emergency communications and tracking. The magnetic movement is restricted by intrinsic safety considerations. These phenomena are the driving factor underlying the design of ULF radio equipment for through-the-earth communications. Extremely low frequency (30-300-Hz) require loop antenna that cannot be used in roaming miner communications devices. The high power level required to drive long wire antennas has limited the ULF radio equipment to one-way, down-link communications. For this reason, ULF transmission should not be used in roaming miner communications systems where quick voice communication is essential.

The coal seam waveguide and conductor/lifeline waveguides support the low frequency LF band (e.g., 30-300-kHz) transmission. Often, higher electrical conductivity sedimentary rock surrounds lower electrical conductivity rock layers. This condition, in addition to dielectric constant changes, forms natural waveguides in the earth where quasi-transverse electromagnetic waves travel great distances. In mudstone and shale sedimentary rock, the electrical conductivity increases from $10^{-3}$ to $10^{-2}$ Siemens per meter (S/m) in the LF band. The conductivity of sandstone, granite, coal, salt, trona, quartz, oil-saturated sandstone, and Gilsonite exhibit conductivities near $10^{-4}$ S/m. The natural waveguide decreases the spread of the EM wave from inverse of radial distance (r) from the transmitting antenna to the square root r of the radial distance. The waveguide increases the operating range. Even when the natural waveguide does not form in the soil and rock medium, the LF Band transmission distance is significant. Advanced LF transceiver design for the Stolar Radio Imaging Method (RIM IV) instrumentation has achieved transmission distances of 400 meters in rock and more than 800 meters in the natural coal seam waveguide at an operating frequency of 100-kHz. The operating distance exceeds 1,600 meters in salt and granite. The RIM IV transceivers employ specially formulated ferrite-rod antennas with operating quality factors greater than 50.

Transmission of UHF electromagnetic waves in larger diameter mine entries and tunnels achieve hundreds of meter with scattering enabling transmission around corners. UHF EM waves are reflected at every air-earth on air-coal interface causing a transmission loss of at least 20-dB. The high attenuation rate of UHF EM in coal and sedimentary rock severely limits transmission distance.

The horizontal lay of the stratified earth overlying a underground mining complex causes radiations from EM wave sources in the mine to be directed straight up. The through-the earth transmission signals from trapped miners with cap-lamp transceivers and ULF band F1/F1 repeaters are subjected to very high reflection loss (R) at the air-earth surface boundary and the rock entry boundary on downward travel. To a lesser extent, at each interface in layered earth geologic model. When reaching the interface, the EM wave is reflected back into the soil or overburden. The RFI noise transmission in the ionosphere-earth waveguide limits the upward transmission distance.

The far field wavefronts are plane surfaces because the RFI is often times generated by sources that are several wavelengths (λ) from the mine. The EM-Gradiometer naturally suppresses plane wavefront RFI noise. A noise minimum near 2,000-Hz would appear to be the optimal frequency for the through-the-earth two-way data and text message transmission. The transmission loss (absorption into heat) is very high in passing through each geologic layer. The ultra low frequency (ULF) transmission parameters are illustrated in Table 1-4.

TABLE 1-4

EM Wave Transmission Factors $\sigma = 0.05$ S/m $E_\sigma = 10$

| Frequency (Hertz) | Loss Tangent | Attenuation Rate (dB/ft) | Phase Constant (β) (Rad/m) | Wavelength(λ) meter (feet) | Skin depth(δ) meter (feet) |
|---|---|---|---|---|---|
| 30 | 3,000,000 | $6.4 \times 10^{-3}$ | $2.43 \times 10^{-2}$ | 2582 (8469) | 411 (1348) |
| 300 | 300,000 | $2.04 \times 10^{-2}$ | $7.69 \times 10^{-2}$ | 817 (2680) | 130 (426) |
| 500 | 180,000 | $2.62 \times 10^{-2}$ | $9.9 \times 10^{-3}$ | 632 (2073) | 101 (330) |
| 1000 | 90,000 | $3.73 \times 10^{-2}$ | $1.41 \times 10^{-2}$ | 447 (1466) | 71 (232) |
| 1500 | 60,000 | $4.5 \times 10^{-2}$ | $1.7 \times 10^{-2}$ | 365 (1197) | 59 (192) |
| 2000 | 45,000 | $5.26 \times 10^{-1}$ | $1.99 \times 10^{-1}$ | 316 (1036) | 50 (164) |

Radiating magnetic dipoles near interface boundaries have equivalent circuits that include the reflected impedance of the boundary. For this reason, the first reflection interface is substantially in the near field. The near reflection loss is omitted from the total path loss.

The reflection loss of air-earth interfaces increases significantly as the frequency is decreased, while the transmission through the air-earth interface improves as the frequency is increased. The loss tangent corresponds to the following electrical conductivity at 2-kHz:

| | | |
|---|---|---|
| Limestone | $\sigma = 0.0044$ S/m | Wet Sandstone |
| Sandstone | $\sigma = 0.022$ S/m | Mudstone |
| Saturated Shale | $\sigma = 0.044$ S/m. | Shale |

The attenuation rate increases with the first power of frequency.

In TTE waveguides, the intrinsic safety considerations limit uplink transmit power and magnetic moment (M) so the magnetic dipole coil inductance and peak circulating flow lies under the UL913 ignition curve. This translates to a maximum magnetic moment (M) to four (4) ampere turn meter$^2$ (ATM$^2$). The down link transmit magnetic moment is not limited, make this communications link realizable with commercially available technology. If the power center or refuse chamber 2000-Hz F1/F1 transceiver and antenna are enclosed in a flame proof enclosure with an intrinsically safe battery, the magnetic moment (m) is not restricted.

Examination of equations 1-13 and 1-15 determines the radial magnetic field component is two times larger (6 dB) then the azimuthal field component in the near field $$\left(\text{distance} < \frac{\lambda}{2\pi}\right).$$

In the far field, the azimuthal magnetic field component predominates. For this reason, deeper mines require TTE communications systems to deploy horizontal magnetic dipole (HMD) antennas.

Equation 1-10 can be used to determine the azimuthal (θ) component of the magnetic field at the surface of the slightly conducting whole space. The magnetic field (H) transmission through-the-earth air interface reflection increases the loss. Table 1-5 illustrates the up-link destination signal to noise ratio.

TABLE 1-5

Through-the-Earth Uplink Transmission Distance Signal to Noise Ratio (SNR) at the Surface ($\sigma$ = 0.05 S/m, M = 4 ATm$^2$) Transmission Frequency in Hertz

| | 30 | 300 | 500 | 1000 | 1500 | 2000 |
|---|---|---|---|---|---|---|
| Earth-Air Reflections loss in-dB Magnetic Field in-dB re 1 A/m ft (m) | −29 | −27.5 | −27 | −25 | −24 | −23 |
| 300 (90) | −122 | −125 | −125 | −124 | −124 | −124 |
| 500 (152) | | −138 | −137 | −138 | −139 | −140 |
| 1000 (304) | | −157 | −158 | −164 | −169 | −173 |
| 1500 (457) | | −170 | −171 | −186 | −194 | −204 |
| RFI Noise in-dB relative to 1 A/m Destination SNR ft (m) | | −136 | −134 | −145 | −145 | −144 |
| 300 (90) | | −16.5 | −18 | −4 | +3 | +3.0 |
| 500 (152) | | −20.5 | −30 | −18 | −18 | +19 |
| 1000 (304) | | −48.5 | −51 | −44 | −48 | −52 |
| 1500 (457) | | −61.5 | −64 | −66 | −73 | −83 |

The destination signal to noise ratios illustrated in the above table show that up-link communications would not be possible through overburden without suppressing the RFI noise. The electromagnetic wave gradiometer (EM-Gradiometer) achieves a RFI noise plane wave suppression of 70 to 80-dB. The destination signal to noise ratio is illustrated in Table 1-6.

TABLE 1-6

EM-Gradiometer Destination Signal to Noise Ratio (SNR) in-dB Transmission Frequency in Hertz

| Depth (ft) | 300 | 500 | 1000 | 1500 | 2000 |
|---|---|---|---|---|---|
| 300 | 53.5 | 52 | 66 | 73 | 73 |
| 500 | 49.5 | 40 | 52 | 52 | 51 |
| 1000 | 21.5 | 19 | 26 | 24 | 18 |
| 1500 | 8.5 | 6 | 6 | −3 | −13 |

Hill (Hill 1994) has mathematically shown that EM-Gradiometer detection sensitivity depends on gradiometer inductive coil separation distance (s) illustrates in FIG. 1-9.

A natural coal, trona, and potash seam waveguide occurs in layered sedimentary geology because the electrical conductivity of shale, mudstone, and fire clay ranges between 0.01 and 0.1 Siemens per meter (S/m) or 100 and 10 ohm-meters. The conductivity of coal, trona, and potash is near 0.0005 S/m or 2,000 ohm-meters. The 10-to-1 contrast in conductivity causes a waveguide to form and waves to travel within the seam.

The electric field ($E_z$) component of the traveling EM wave is polarized in the vertical direction and the magnetic field ($H_y$) component is polarized horizontally in the seam. The energy in this part of the EM wave travels laterally in the coal seam from a transmitter to a receiver. There is a horizontally polarized electric field ($E_x$) that has zero value in the center of the seam and reaches a maximum value at the sedimentary rock-coal interface. The $E_x$ component is responsible for transmission of the EM wave signal into the boundary rock layer. The energy in this part of the EM wave travels vertically and out of the coal bed (e.g., the coal seam is a leaky waveguide). Energy in the EM wave "leaks" into the fractured rock overlying the coal bed, thus, weaker roof rock is detected with Stolar Radio Imaging Method (RIM) tomography. Fractures in the boundary layer increase the roof fall hazard. Roof control measures should be intensified in these areas. In roof fall hazard zones, the attenuation rate of the EM wave rapidly increase. Due to this waveguide behavior, the magnitude of the coal seam radio wave decreases because of two different factors. The EM wave magnitude decreases because of the attenuation rate and cylindrical spreading of wave energy in the coal seam. The cylindrically spreading factor can be mathematically described by $1/\sqrt{r}$ where r is the distance from the transmitting to the receiving antenna. This factor compares with the non-waveguide far-field spherically spreading factor of 1/r. Thus, at 100 meters, the magnitude of the EM wave within the coal seam decreases by a factor of only 10 in the waveguide and by a factor of 100 in an unbounded medium. An advantage of the seam waveguide is greater travel distance. Another advantage is that the traveling EM wave predominantly remains within the coal seam waveguide (e.g., the coal bed).

Coal seam EM wave are very sensitive to changes in the waveguide geology. The radio-wave attenuation rate in decibels per 100 feet and phase shift in electrical degrees per 100 feet are well known. The EM wave is called a zero order mode quasi-transverse EM wave. All waveguide modes above the zero order are cutoff. This phenomenon means that the EM wave does not bounce from the roof to the floor as it would in a multi-mode case. Multi-path propagation is suppressed by the relatively high attenuation rate.

The effect of attenuation in the seam waveguide is to reduce the magnitude of the EM wave along the path. The coal seam attenuation rate increases with frequency. The wavelength increases as frequency decreases, which, for example, gives RIM greater operating range.

Under sandstone sedimentary rock, the attenuation rate increases because more of the RIM signal travels vertically into the boundary rock (e.g., leaks from the waveguide). If water is injected into the coal from an overlying paleochannel, then clay in the coal causes the electrical conductivity and attenuation rate and phase shift to increase.

The attenuation rate significantly increases under sandstone paleochannels. Along the margins of paleochannels, the channel scours into the bounding shale sedimentary rock. Differential compaction rapidly degrades roof rock strength.

Roof falls are likely to occur along the margin, suggesting that ground control should be increased in this segment of mine entries. The attenuation rate and phase shift rapidly increase with decreasing seam height. Seam thinning is detected easily by transmitting an EM signal in the waveguide and measuring the attenuation rate. A graphical presentation of coal seam waveguide attenuation and phase constants represents the science factor in the art and science of interpreting EM sensor wave tomographic images. Higher attenuation rate zones suggest that the coal seam boundary rock is changing, the seam is rapidly thinning, and/or water has been injected into the coal seam. The seam waveguide is effective in the frequency range above 10-kHz to at least 500-kHz. Near the low-frequency limit, in-mine experiments suggest that exciting the seam transmission mode with reasonable size loop (e.g., magnetic dipole) antennas is difficult. At the high-frequency limit, the attenuation rate of the wave increases and limits the operating range. Faults and dykes cause reflections to occur in the waveguide. The reflections can appear as excess path loss. Total phase shift measurements are useful in detecting reflection anomalies.

The induced current (I) in long, thin electrical conductors when illuminated by the electric field component (E) of the EM wave can be mathematically represented by, $$I = \frac{2\pi E}{i\omega\mu \ln(ka)} \tag{1-59}$$

where, $\omega=2\pi f$ and f is the frequency in hertz of the primary EM wave, $\mu=\mu_o\mu_r$ is the magnetic permeability of the surrounding rock mass, $\mu_o=4\pi\times10^{-7}$ farads per meter and $\mu_r=1$ in most natural media, $k=\beta-i\alpha$ is the wave propagation constant where $\beta$ is the phase constant and $\alpha$ is the attenuation rate, and a=the radius of the conductor in meters.

For a thin electrical conductor in a tunnel, the Equation 1-54 teaches that the induced current increases with the amplitude of the primary EM wave electric field component (E) that is tangential to the electrical conductor and inversely with frequency ($\omega$). Therefore, lower frequency EM waves induce higher current in these electrical conductors. Actual measurements conducted at the Colorado School of Mines (CSM)-United States Army Belvoir Research and Development Engineering Center (BRDEC) tunnel proved that the induced current as defined in Equation 1-34 increased as frequency decreased (Stolarczyk 1991). For a magnetic dipole source, the longitudinal electric field component can be mathematically represented by, $$E_\phi = \frac{i\mu\omega M k^2}{4\pi}\left[\frac{-1}{(kr)^2} + \frac{1}{i(kr)}\right]e^{-ikr}\sin\phi, \tag{1-60}$$

where, M=NIA is the magnitude of the magnetic moment (e.g., turn peak ampere square meters), and $\phi$=the azimuthal angle in degrees.

Because of the $\omega$ term in Equation 1-55, the electric field vanishes at zero frequency. For a magnetic dipole transmitter, increasing frequency, maximum current flow in a nearby electrical conductor. Consequently, a TTE frequency should not be used in communication with the conductor (conveyor belt) lifeline waveguide. The vertical magnetic dipole (VMD) integrated with the cap-lamp battery forms the magnetic fields (blue) shown in FIG. 1-8. The electrical field component is horizontally polarized for maximum induction of current into conductor installed on the entry ribs.

The EM waves scattered from the electrical conductor slowly decay with distance from the conductor at radial distances that are large compared with the skin depth, $$H_s = -\phi\frac{iI_s k}{4}H_1^{(2)}(kr) \tag{1-61}$$

and $$E_s = -Z\frac{\omega\mu 1_s}{4}H_o^{(2)}(kr), \tag{1-62}$$

where, $H_s$ is the scattered magnetic field, $E_s$ is the scattered electric field, $I_s$ is the secondary current, $\phi$ and Z are unit vectors, $H_o^{(2)}$ and $H_1^{(2)}$ are Hankel functions of the second kind (order 0 and 1), and r is the radial distance in meters to the measurement point.

At radial distances that are large compared with the skin depth, the asymptotic formula of the Hankel function leads to simplified expressions $$H_s \approx \phi\frac{1.}{2}\left(\frac{ik}{2\pi r}\right)^{\frac{1}{2}}e^{-ikr} \tag{1-63}$$

and $$E_s \approx -Z\frac{\omega\mu 1.}{2}\left(\frac{i}{2\pi kr}\right)^{\frac{1}{2}}e^{-ikr}. \tag{1-64}$$

The secondary cylindrically spreading (e.g., scattered) EM waves decay with the one-half power of distance (r) from the conductor and are decreased in magnitude by the attenuation factor $e^{-\alpha_r}$. Hill reformulated the problem for finite length conductors and non-uniform illumination by a magnetic dipole source (Hill 1990). In this case, standing waves occur on the underground conductors. In a passageway with multiple conductors, the standing wave pattern is not observable because of multiple reflections in the ensemble of electrical conductors (Harrington 1961). Bartel and Cress used forward modeling codes developed by Gregory Newman to show that current flow is induced in reinforced concrete (Bartel and Cress 1998). Passageway conductors form low-attenuation-rate transmission networks (waveguides) for distribution of induced current throughout the mining complex.

The bifilar attenuation rate is less than 1.0-dB per kilometer at 50-kHz. The current appears on the conveyor belt and structure, and electric power and telephone cables.

The passageway waveguide transmission mode operates in the UHF (e.g., 300 to 3,000 MHz) band. Passageways form waveguides for transmission of electromagnetic waves.

A passageway waveguide transmission is possible when one-half wavelength is less than the width and height of the tunnel. When the half wavelength is greater than the passageway dimension, evanescence waves form that not propagate in an underground passageway and the transmission is said to be cutoff. Waveguides exhibit a very high attenuation rate when operating in the evanescence mode. Ultra high frequency (UHF) band transmission has been found to provide quality communications because of its favorable wavelength. Rock falls in the passageway or narrowing down of the opening initiate the evanescence mode of wave propagation. The attenuation rate also depends on loss associated with the roof, floor, and rib rock electrical parameters, plus wall roughness and tilt. Absorbing wall conditions occur when UHF-band transceivers are operated in mining sections, but cannot solve a mine-wide communications problem. Miners in non-metal underground mines conduct operations over long periods of time in localized zones. In these mines, leaky-feeder cable and repeater transceivers installed at 500 to 1,000-foot intervals can provide roaming miners with communications.

Leaky feeder or fiberoptic transmission facilities are being installed in the man and material (M&M) entries in support of mining operations (monitoring environment and machines). For the most part, M&M entries already have electrical conductors such as rail, conveyor belts structure and metallic cables that support Hill-Wait bifilar mode transmission. Even though the leaky feeder or fiberoptic transmission facility fail in a significant event, they would not be needed after the event since mining equipment is shut down. The conductor/lifeline waveguide transmission facility most likely remain operational after the event.

The leaky feeder or fiberoptic transmission facility is merged with the cable/lifeline waveguide (CLLW) to form a narrow and wide bandwidth transmission facility. A leaky feeder of fiberoptic cable designed with two insulated sixteen gauge conductors to support the LF band Hill/Wait bifilar mode transmission. If the leaky feeder or fiberoptic cable is installed in M&M entries, the Hill/Wait bifilar mode of transmission already exists. Conductor/life line is installed in every entry not served by the leaky feeder/fiberoptic transmission facility.

Such depends on two types of communications devices. A cap-lamp and refuse chamber transceiver with through-the-earth, conductor/lifeline and UHF transmission capability. This concept is realized by integrating a software definable transceiver (SDT) in the cap-lamp transceiver. The cap-lamp transceiver include an analog 900 MHz narrow band FM or an internet protocol transceiver. The LEW and CLLW transmission requires 2000-Hz and LF band F1/F1 transceivers. To ensure that the emergency and operational transmission remains operational after an event, voice/text message transmission is divided between narrow and wide bandwidth transmission facilities.

Efficient antenna designs use very long wires for through-the-earth, air-core or ferrite-rod loop antennas for guide-wire or natural waveguide, and monopole antennas for wide bandwidth transmission. An important design requirement is driven by the high-Q design requirement of magnetic dipole antennas.

Figure 9:
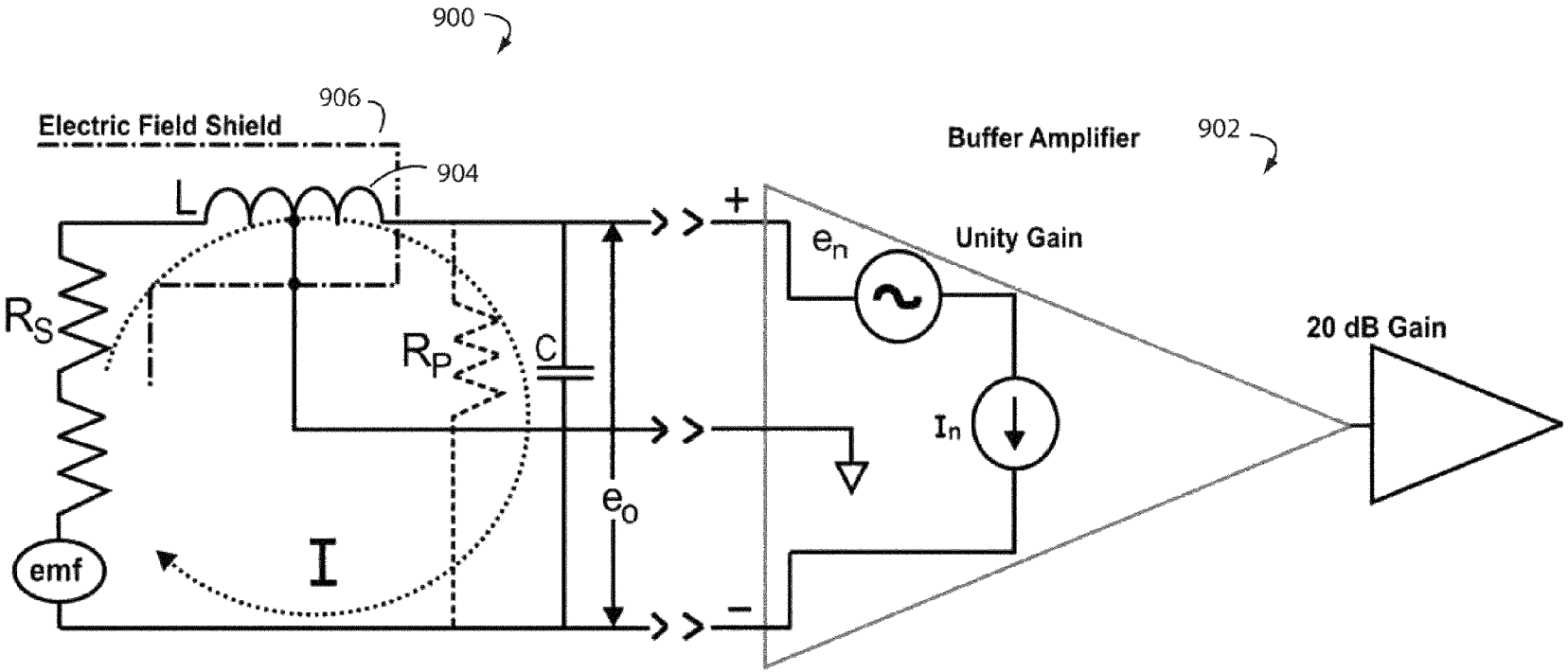
FIG. 9 is a schematic diagram representing a receiver antenna and first stage buffer amplifier.

FIG. 9 represents a receiver antenna 900 and first stage buffer amplifier 902. A ferrite rod antenna 904 includes an electric field shield 906 to significantly suppress electric field induced noise. The EM wave magnetic field component threading the area of the induction coil, consisting of N-number of turns, produces an electromotive force voltage (EMF) that can be mathematically represented by, $$emf = -N\frac{d\phi}{dt}, \tag{1-65}$$

where, $\phi$=BA is the magnetic flux in Webbers;

B is the magnetic flux density in tesla (weber per square meter) and A is the effective area of the magnetic dipole antenna in square meters.

For a sinusoidal magnetic flux, the EMF voltage induced in the antenna can be mathematically represented by, $$\text{emf}=iN\omega(\mu_r A)\mu_o H B, \tag{1-66}$$

where, N is the number of turns of the electrical conductor used in building the induction coil wound on the ferrite rod;

H is the magnetic field in amperes per meter; and $\mu_r$ is the relative permeability of the ferrite rod antenna.

A ferrite rod with an initial permeability of 5,000 and a length/diameter ratio of 12 achieves a relative permeability of 120. The induced EMF increases with the number of turns (N) and first power operating frequency $\omega$, therefore, the transmission frequency used should be as high as possible to take advantage of $\omega$, but still low enough for the illuminating primary wave to encounter a low attenuation rate. The voltage also increases with the first power of effective area ($\mu_r$A) and magnetic field (H) of the illuminating EM wave. For a 1-inch-diameter ferrite rod, the area can be mathematically represented by, $$A=\pi(0.0127)^2=5.07\times10^{-4}\text{ square meters.} \tag{1-67}$$

and the effective area is 120 A=$6.04\times10^{-2}$ square meters.

For a 30-inch diameter aircore loop, $$A=\pi(0.38)^2=0.456\text{ square meters}$$

The United States Air Force High-Frequency Active Aurora Research Program (HAARP) 2-kHz transmitter modulation of the electrojet signal is expected to produce a picotesla ($10^{-12}$ Webbers/square meter) signal causing the 30-inch diameter air core induction coil to produce a signal given by, $$emf = -i(120)(4\pi\times10^3)(0.456)(10^{-12}) \tag{1-68}$$

$$= 0.68\text{ microvolts per picotesla}$$

The noise is expected to be 0.02 picotesla in a 1-Hz bandwidth. The S/N ratio would be $$SNR = \frac{32\times10^{-12}}{0.02\times32\times20^{-12}} = 50. \tag{1-69}$$

A software-defined radio (SDR) is a very high-speed, two-channel digital platform. A field-programmable, gated array (FPGA), digital signal processor (DSP), and microcontroller have been designed and built for interfacing with RF circuits, microphones, and speakers.

The definition of the quality factor (Q) is used to understand the importance of the narrow bandwidth (BW) in magnetic dipole transmission.

$$Q = \frac{f_o}{BW} = \frac{\text{peak energy stored}}{\text{energy dissipated per cycle}} \tag{1-70}$$

$$= \frac{1/2Li_{RK}^2}{P_d/2\pi f_o}. \tag{1-71}$$

If L $\propto$ $N^2$ A, then $$BW = \frac{N^2 I^2 A}{P_d}, \tag{1-72}$$

$$M = NIA\text{, and} \tag{1-73}$$

$$\sqrt{\frac{P_d}{BW}}\ \alpha M. \tag{1-74}$$

Mining complexes usually extend over large underground areas. Radio communications and tracking systems must be compatible with the expanding nature of the mining process and the maintenance difficulties encountered in the real mining environment. The maintenance problem is aggravated by the shortfall in training for mining technicians and engineers, who now require extensive training in safety and operational procedures.

The MINER Act addresses emergency communications and tracking of personnel entering underground mines. Because emergency conditions require quick mine-wide radio communications and tracking, the equipment must be extremely reliable and roaming miners must be trained in its operation. Unlike an atmospheric or office environment, the system must be self-healing, redundant, and failsafe both during and after an event. These characteristics are achieved through ruggedizing the design for the transmission networks operating in the natural and manmade waveguides and through temperature/vibration cycling as part of the production process. By using a self-healing transmission network design, explosion rockfalls and exceedingly high fire temperatures of severe incidents not disrupt the integrity of the communications network. Mining companies are unlikely to provide extreme reliability in maintaining separate emergency and operational systems. Therefore, an integrated emergency and operational system has considerable advantages. The advanced capabilities of the design are in stark contrast with early examples of communications and tracking technology. For the most part, current systems are a collection of commercial radio technologies developed for the terrestrial market needing leaky feeder or locating wired systems in different entries. The history of mine explosions and fires demonstrates the many technical shortfalls of today's commercial radio technology when applied in the underground mining environment.

Studies of past mine disasters have found that in wired mines telephone wire pairs either burned or were cut in two, preventing emergency communications between trapped miners and between the trapped miners and the surface. Information detailing the emergency conditions must be received in the first few minutes after an incident or the incident escalates out of control.

If the leaky feeder system exceeds the 0.25-millijoule energy level in sourcing power through the leaky feeder cable, the leaky feeder cable communications system cannot be used when ventilation is lost. Some environmental monitoring systems that source power through the monitoring cable must also be shut down if they exceed 0.25-millijoule energy limit. The PED system must be shut down when ventilation is lost.

Survivability of robust radio communications and tracking systems must be addressed. Rail lines, conveyor belt structures, water pipes, power cables, and steel cables are more likely to withstand a mine accident than a fragile VHF/UHF antenna structure, telephone wire pairs, leaky feeder cables, or small-gauge wires. These fragile transmission systems are likely to fail in an explosion or fire. Natural waveguides in the layered earth geologic model and developed infrastructure are likely to survive catastrophic events. The self-healing F1/F1 transmission network designed with the yellow CAT lifeline loop in every passageway enable the transmission network to survive. The working section power center (s) and refuse chamber (s) include very narrow bandwidth 2000 Hz transmission facility-tying the end of the emergency communication link to the surface and the EM-Gradiometer receiver. The power center and refuse chamber also include the narrow bandwidth yellow CAT LF transmission facility that includes F1/F1 repeaters. Even with a robust transmission network in place, such as RadCAT, control software must be self-organizing and self-healing if disruptions should occur. Currently designed mine-wide environmental monitoring systems cannot maintain operation in explosive conditions or when mine ventilation is shut down. A network can support environmental monitoring of methane and oxygen levels as well as tracking information.

The mining complex development includes multiple working faces and entries with cross cut and "stopping" to direct ventilation-fresh and return air flow. An event has trapped mine personnel near the working face. Each entry has an installed "yellow CAT" Life Line cable with at least two insulated copper conductors that supports the Hill/Wait "bifilar" mode of electromagnetic wave transmission. The yellow CAT cable with multi core fiber optic (FO) be installed in man and material entries. The yellow CAT-2 cable includes at least two insulated copper conductors. The conductors supply power to MSHA approved flame proof enclosure with intrinsically safe batteries. The changing current is only available in fresh air entries and shut off in an event.

The reflectors used in both primary and secondary escape ways are only reflective on one side. If the miner points the cap-lamp into the mine reflectors can not be seen. If the cap-lamp is pointed out of the mine, the miner see blue reflectors in the intake airway (primary escape way), red reflectors in the return airway and green in the neutral air beltline.

systems use existing installed conductor waveguides in a typical mining complex as well as the natural waveguides represented by the layered earth comprising the overburden and the coal seam that is being mined. These waveguides allow the transmission of EM waves or radio signals over the distances required to accomplish effective tracking and communications under both emergency and operational conditions.

Robust conductor transmission waveguides are already installed as utilities in many, but not all, mine passageways in underground mines. Mine personnel caught in a mine fire commonly report having difficulty determining the correct way out, suggesting the need for a guide wire or cable with directional indicators to facilitate egress from smoke-filled mine entries (U.S. Pat. No. 5,146,611, issued Sep. 8, 1992).

In passageways without conductors in place, the yellow CAT lifeline multi-strand steel core cable can serve as a lifeline transmission waveguide. However, the yellow CAT lifeline cable includes at least two insulated conductors to enable Hill-Wait monofilar-mode and bifilar-mode signal transmission and recharging intrinsic batteries deployed in the transmission facility. Low-cost passive RFID tags provide location identification. Blue tags are intake airways with the blue side showing way-out. Red tags are return airway with the red side showing way-out. These tags replace the way-in (red)/way-out (blue) tags installed in all passageways in United States mining complexes, as required by MSHA.

RFID tags can be integrated into the design of the Yellow CAT lifeline. Each RFID tag is powered up by a periodic 130-kHz burst transmission from the cap-lamp transceiver. The RFID tag retransmission is received by the cap-lamp transceivers. First, a synthetic voice generated in the transceiver tells the roaming miner that he is heading out in, for example, 3$^{rd}$ right at XC31. The time stamp, transceiver identification, and location are transmitted by the cap-lamp transceiver through the 200-kHz F1/F1 repeater bi-directional network for posting on the LCD included in the SACS, as well as any underground tracking LCDs.

The passive RFID tags are installed at 50 feet intervals in every entry in the mining complex. If RFID tags were located on each roaming miner and reader at specified locations, then multiple miners in moving vehicles could not be separately identified.

Electrically, the attenuation rate of the conductor/lifeline transmission waveguide is less than 1-dB/1,000 meters at 100-kHz. The attenuation rate increases to 3-dB/1,000 meter at 300-kHz, which can be compared with the attenuation rate of 21-dB/1,000 feet for leaky-feeder cable at 450 MHz and a requirement to station leaky feeder two-way amplifiers at intervals of 1,500 feet. Thus, the LF band conductor/lifeline attenuation rate can be as much as approximately 20 times less than the attenuation rate of the VHF/UHF-band leaky feeder cable. Previous deployment of mine-wide LF/MF wireless technology experimentally found that coupling to guide-wire waveguides was maximum in the 200- to 300-kHz frequency band. The LF/MF band attenuation rate of radio signal transmission in the natural seam-mode waveguide is less than 5-dB/100 feet in coal and less than 3-dB/100 feet in potash and trona seams. In metalliferous mines, the attenuation rate through host rock is often less than 16-dB/100 feet. The effective transmission or communication distance depends on the electrical conductivity of the natural medium.

From an emergency communications standpoint, enough of the robust conductor and seam-mode transmission waveguide structures are likely to survive the initial effects of most severe mine events to keep the network functioning. The 2000-Hz transmission facilities at the power center or refuse chamber closes the communications path to the surface. This statement is especially true when bi-directional (self-healing) transmission networks are employed. In such events, communications still would be possible with conductor/lifeline and seam waveguides LF band signal. The F1/F1 networks have an overlay of at least five operating digital-modulated frequency (FSK) carrier frequencies.

Because mines are in a constant state of development, the communications system needs to be constantly expanding. From an operations standpoint, the use of in-place and natural transmission waveguides would minimize installation and maintenance costs of an underground radio system. In the system, the F1/F1 repeater with 1.5 meter-diameter loop antennas provides a 2000-foot radius communications coverage area in by the last open crosscut. The F1/F1 repeater transceiver and battery is installed in a flame proof enclosure with an intrinsically safe battery, the coverage and radius exceed 2000 feet.

In a leaky feeder coaxial-cable radio system, the cable cost and installation can exceed $2.50/foot. Reliable repairs to coaxial cables are difficult to achieve in the damp and often dusty mine environment. Although the emergency, operational, and economic advantages of LF/MF radio systems were apparent in the earlier United States Bureau of Mines (USBM) and South African Chamber of Mines (SACM) LF/MF work, technological breakthroughs were required before a practical mine-wide radio system could be successfully installed and operated in an underground mine. Although the prior work experimentally demonstrated more than 3,000 feet of coal seam waveguide and 20,000 feet of conductor/lifeline waveguide distance in roadways with in-place conductors, mine-wide mobile-to-mobile communication was not possible in large multiple-passageway mining complexes. The problem was resolved by developing the yellow CAT lifeline (U.S. Pat. No. 5,146,611, issued Sep. 8, 1992), which is an affordable installation in all entries of small and large underground mines. The LF/MF mine-wide radio communication technology barrier was identified as a problem relating to the inability of repeaters to interact and efficiently couple radio signals between mobile radios and the in-place conductor-transmission-line and coal seam waveguides. Repeaters can extend the lateral transmission distance from the conductor/lifeline at least 100 feet.

A simple yellow CAT lifeline was introduced into underground mining in Utah Power and Light's Cottonwood and Deer Creek coal mines in the late 1980s. U.S. Pat. No. 5,146,611, issued Sep. 8, 1992, describes the method of building the Hill and Wait modal propagation into a lightweight mine emergency communications cable featuring multiple strong synthetic fibers, non-insulated conductors, and at least one insulated copper wire. This cable was installed in a number of United States and Australian coal mines.

In embodiments of the present invention, a conventional yellow CAT cable is modified to include a multi-strand steel cable with at least two insulated copper conductors to enable Hill-Wait monofilar and bifilar transmission modes. The two insulated copper conductors distribute power through fresh air entries to trickle charge intrinsically safe batteries protected by the MSHA-approved battery (U.S. Pat. No. 5,301,082, issued Apr. 5, 1994). The three insulated conductors in the cable minimize stress in the cable. The recharging current must be shut off when ventilation is disrupted. The yellow CAT cable be advanced in design to include multi core of fiber optics for wideband high speed data transmission. The cable design include specially designed connectors for rapid expansion of the mining complex.

A yellowCAT-2 life line cable design includes a reflective yellow jacket with way-out indicators. A fiber optic (FO) core is placed inside of a protective tube to illuminate strain on the fiber optic member. Each protective tube be color coded. The insulated copper conductors be identified with red and black insulation.

MSHA approved flame proof enclosures are used for all equipment required in the transmission facility. Cables designed for leaky feeder transmission have shields that support only the monofilar mode with very high attenuation rate, which is a factor of ten greater than the bifilar mode. The coupling from the transceiver is based on electric field induction of current in the monofilar transmission mode in the yellow CAT cable design. Because of impedance changes along the unshielded yellow CAT cable, reflections convert the monofilar mode to the bifilar mode with an exceedingly low attenuation rate. An MSHA-approved yellow plastic cover with Braille-type way-out indicators serve as the outer cover of the yellow CAT lifeline. The yellow CAT cable be installed through all entries without electrical conductors.

The yellow CAT life line includes at least two insulated copper conductor and multi-stand steel cable or Kevlar core strength member is with an MSHA-approved yellow cover. Fiber optic core is included in the yellow CAT-FO2 installed in man and material entries. The electromagnetic wave transmission distance along the yellow CAT cable can be determined from in-mine measurement. The transmit magnetic dipole coupling factor is 20-dB. From that point on the vertical axis, a linear line with slope equal to the bifilar attenuation rate of 0.001-dB/foot is typical. The radio receiver RFI, with the transmitter turned off, represents the. RFI at that location in an underground mining complex (e.g., ~120-dB).

The required destination signal-to-noise ratio for the transmission network is 40-dB. As indicated in FIG. 2-4, the transmission signal-to-noise ratio is achieved for transmission distances of less than 60,000 feet. For a destination signal to noise ratio of 40 dB, the transmission distance exceeds 60,000 ft at a carrier frequency in the low frequency band (30-300-kHz).

At each power center serving a working section, through-the-earth (2000 Hz), conductor/Life Line and face area CSW F1/F1 repeaters be integrated and moved with the power center. A through-the-earth waveguide repeater provides two-way (ULF-ultra low frequency—2,000 Hz) text message and voice transmission to the surface. A transceiver on the surface provides a return text and voice message link. With a transmitter on the surface, the text and voice messaging symbol rate is 80 bits per second (one symbol per second). The Conductor/Life Line Waveguide (CLLW) LF F1/F1 repeater provides work area coverage in the coal seam waveguide (CSW). The operating frequency is in the LF band (250, 275, and 300-kHz) for synthetic voice, voice, text messaging and tracking. Separate carrier frequency and F1/F1 repeaters are provided for supervisors networking, maintenance networking and tracking system. RFID tags can be integrated with the yellow CAT cable at 50-ft intervals.

Each roaming miner is equipped with a cap-lamp transceiver designed to communicate in all waveguides and initiate RFID tag location transmission.

Figure 13:
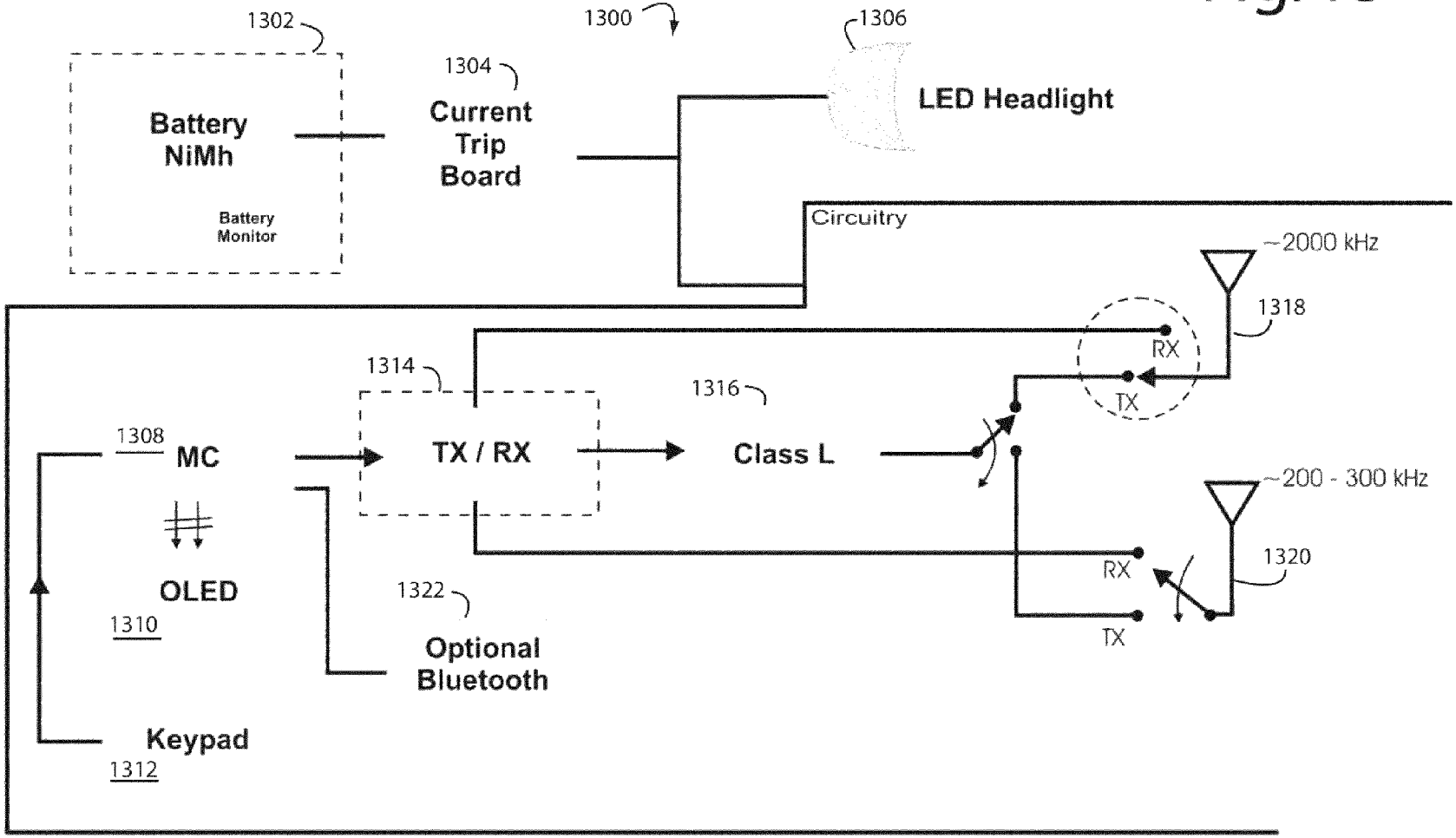
FIG. 13 is a functional block diagram of a cap-lamp transceiver embodiment of the present invention.

FIG. 13 represents a cap-lamp transceiver 1300 that provides two-way, simplex-half duplex digital transmission at the frequencies in the LF and VHF/UHF bands and includes operational links to a passive RFID tag tracking system. A battery 1302 is made intrinsically safe by a current limiting board 1304. These power an LED headlight 1306, a microcomputer (MC) 1308, an organic LED display 1310, and a keypad 1312. A software-defined and agile ULF-UHF radio transmitter/receiver 1314 drives a Class-L amplifier 1316 connected through T/R switches to a 2000-kHz antenna 1318 and a 200-300 kHz antenna 1320. A BLUETOOTH device 1322 provides connectivity with a PDA like a BLACKBERRY.

The through-the-earth emergency transmission is achieved via the 2000-kHz link from the cap-lamp to a ULF F1/F1 transceiver located at the power center or refuse chamber. The transceiver 1300, includes a text message display 1310 and a touch screen keyboard 1312 for text messaging and received message display. A Blackberry-type PDA can be interconnected to the cap-lamp transceiver and F1/F1 network through a Bluetooth communications link. The situation awareness computer system (SACS) graphical display can be updated to indicate location icons of mine assets and roaming miners updated on the PDA display.

A text messaging device would be built into a cap-lamp battery. A ULF and LF/MF-band digital SDT board are used. A typical cap-lamp battery 1302 is 10-ampere/hour nickel hydride, and the lamp 1306 uses light-emitting diode (LED) clusters. A microphone and speaker can be included to enable peer-to-peer voice communications.

In some embodiments, an analog VHF/UHF FM transceiver is integrated with the digital core to enable voice communications with leaky feeder cable transmission systems.

A field-programmable, gate array (FPGA) enables a cap-lamp to execute signal processing software, which can support an extensive library of synthetic voice and text messages.

The embedded Bluetooth protocol enables 2.4 GHz communications between external devices. Additional transceiver inputs enable a miner's health to be monitored in real time. The Bluetooth link enables the PDA transmission of a foreman's report, including production data and maintenance advisories, to the cap-lamp and through a CLLW 225-kHz F1/F1 repeater network to the mine operations center. The cap-lamp transceiver effectively merges the emergency and operational communications systems.

When transceiver 1300 is operating in its TTE transmission mode, a cap-lamp 200-kHz link to the power center or refuse chamber LF F1/F1 transceiver demodulates the text or voice message and couples the demodulated message to the 2000 Hz F1/F1 transceiver for transmission through the earth. The radiation term in Equation 1-13 predominates in deeper mines, which implies that the cap-lamp transceiver should be designed with a horizontal magnetic dipole (HMD) for transmission through CSW waveguide. However, for transmissions of LF signals into the Conductor Lifeline Waveguide (CLLW), a vertical magnetic dipole (VMD) should be used. Consequently, both a HMD and a VMD antenna must be incorporated into the transceiver. In addition, a HMD antenna must be used when using the transceiver to couple to the coal seam waveguide.

The MINER Act requires lifelines with directional indicators to be installed in all entries of an underground coal mine. A lifeline design can include a multiple-strand steel support cable core along with a small-diameter insulated copper wire. The wire ensemble be enclosed in an MSHA-approved thermal plastic yellow cover. The lifeline supports the Hill-Wait monofilar and bifilar modes of electromagnetic wave transmission along the yellow CAT lifeline.

Low-cost passive RFID tags can be used to replace the two-sided tags deployed in the mine entries. Each RFID tag is encoded, for example, with an entry designation (e.g., 3$^{rd}$ left) and crosscut number (e.g., X41).

transceivers automatically burst an LF 134-kHz transmission to power up RFID tag, evoking a location transmission to the nearby cap-lamp transceiver. The transceiver turns on and transmits the location and miner identification number through the 200-kHz F1/F1 network. Since the F1/F1 repeater network operates as a receiver at 200-kHz, the passive RFID tag transmission is suppressed by a filter in the 200-kHz F1/F1 repeaters and not assigned to the tracking network. Transceiver filters in the other network transceivers suppress tracking signal transmissions.

Mine fires create smoke that can blind miners trying to escape. When a miner with a transceiver passes a passive RFID tag location, a synthetic voice speaks out, "you are headed out, 3$^{rd}$ left at crosscut 30", which is the actual miner's current location. By command from the surface, the synthetic voice may give alternative escapeway information.

For example, in the Wilberg Coal Mine fire, the only escaping miner went through a neutral air beltline return to escape from the longwall face. If the trapped miners could have received this information, they would not have died waiting for the call that could not be transmitted over the burned down cable in the longwall man and material entry.

Table 2-1 summarizes the EM characteristics of TTE tracking or communication transmission links.

TABLE 2-1

Summary of the EM Characteristics of a Through-the-Earth Tracking or Communications Link.

Layered strata cause a vertical waveguide to form.

Electrical conductivity ($\sigma$) increases with frequency.

Attenuation rate through overburden depends on electrical conductivity.

The upward traveling EM wave from the tracking beacon, 2000 Hz F1/F1 repeater, or cap-lamp transceiver has EM components described by Equations 1-27 through 1-29.

For surface depths greater than the skin depth given by

Equation 1-56, the radiation term $\left(\frac{1}{kr}\right)$ predominates, which means that the surface EM signal is larger for the transmitter ferrite rod deployed as a horizontal magnetic dipole (HMD). The skin depth is 50.3 m at 2-kHz for TABLE 2-1-continued

| Summary of the EM Characteristics of a Through-the-Earth Tracking or Communications Link. |
|---|
| $\sigma = 0.05$ s/m and a relative dielectric constant $\epsilon_r = 10$. The wavelength is 316 m and the loss tangent is $4.5 \times 10^4$. The overburden impedance is 0.56 ohms. The index of refraction is $n = \frac{c}{v} = 470$. |
| The air-surface interface reflects most of the EM wave back into the overburden soil. At 1,000-kHz, only about 3% of the EM wave is transmitted through the interface. |
| The reflection loss and attenuation for typical overburden soils is such that the total attenuation is estimated to be approximately 86-dB at 2000 Hz. |
| The surface radio frequency interference (RFI) spectrum is such that the noise is essentially plane waves that can be rejected by measuring gradient fields on the surface. |
| The surface signal measurement detection sensitivity is given in Equation 1-24. The detection depth of signals transmitter from the tracking beacon or cap-lamp transceiver with a magnetic moment of 4 can be estimated from table 1-6 and 1-7. |
| Enclosing the antenna and 2000 Hz F1/F1 repeater transceiver in an MSHA approved flame proof enclosure with a trickle charged intrinsically safe battery enables the magnetic moment (M) to be increased by at least 40-dB. |

Polarized magnetic field lines pass through the ferrite rod magnetic dipoles. The field lines lie on the surface of an expanded torris, representing radiation. The companion electric fields are horizontally polarized and encircle the ferrite rod. The horizontal electric field on the ferrite rod induces strong currents in the conductor component located on the rib of the entry. Wenker current is induced in conductors located on the roof of the entry. Fewer dead spots occur along man and material entries. The transceiver transmits an EM wave electrical field component (E) in the LF/MF band that induces (couples) a current signal in the yellow CAT cable. The induction current (I) flow that is mathematically given by, $$I = \frac{2\pi E}{i\omega\mu \ln(ka)}, \tag{2-1}$$

where $\omega=2\pi f$ and f is the frequency in hertz of the primary EM wave, $\mu=\mu_o\mu_r$ is the magnetic permeability of the surrounding rock mass, $\mu_o=4\pi\times10^{-7}$ farads per meter and $\mu_r=1$ in most natural media, $k=\beta-i\alpha$ is the wave propagation constant where $\beta$ is the phase constant and $\alpha$ is the attenuation rate, and a=the radius of the conductor in meters.

Equation (1) indicates that the induction current (I) decreases with the first power of frequency ($\omega$) and the first power of the electric field component (E).

As the current flows along the yellow CAT cable, a radiating magnetic field component (H) is generated, which couples F1/F1 signals to the transceivers, is mathematically given by, $$H \approx \frac{1}{2}\left(\frac{ik}{2\pi r}\right)^{1/2} e^{-ikr}, \tag{2-2}$$

where r is the radial distance to the measuring point.

Increasing the cable radius (a) decreases the induced current (I). The radiating magnetic field spreading factor is dependent on the square root of distance (r) from the cable. The square root of r spreading is important when considering coverage in the mine entry. The coverage area is approximately 100 feet from the yellow CAT cable at the repeater location decreasing to 100 feet at a distance of 2,000 feet from the repeater. At greater distances, the coverage area is at least the entry width. At 100-kHz, the attenuation rate along the yellow CAT cable is only 1-dB per 1,000 feet, approximately 20 times less attenuation rate than a leaky feeder cable.

One option to maximize receiver detection sensitivity is to minimize the instantaneous bandwidth (BW) of all system receivers. The option of increasing transmit power is restricted in view of the MSHA intrinsic safety regulation and approval procedures. The specified 10-MHz bandwidth of leaky feeder receivers causes the detection sensitivity to be 30-dB worse than the system receivers. Leaky feeder or monitoring systems that supply power throughout the cable system are not safe and must be de-energized when ventilation is shut down. The design requirements for modern land and satellite transmission networks are wideband, violating the fundamental laws of radio geophysics governing transmission through slightly conducting media. Although the radio communications and tracking system design is predominantly controlled by radio geophysics considerations, the design is also critically dependent on standard communications theory.

Through the years, modulation processes have been developed to increase the information transmission rate, initially using an analog process. In recent years, digital processes predominate design requirements. Digital modulation processes advanced with the development of coding theory, requiring protocols to enable synchronization and interface with other networks and equipment. Digital transmission networks are extremely wideband to enable synchronization and service subscriber's data transmission.

Leaky feeder transmission systems are being installed in United States mines as a first step in complying with the MINER Act of 2006. Over 180 systems be installed by mid year. Installing a leaky feeder mine-wide radio system in all entries of the mining complex is economically infeasible to justify. The economic justification for installing these systems in men and material entries can be made, but not in escape ways, return entries, and barricade or rescue tents when miners are in emergency situations. Today's advanced mining equipment is being designed for monitoring and automated control systems. The speed of operation in some cases exceeds the physical capabilities of a mine operator. A wideband transmission facility be achieved with leaky feeder or fiber optics. The system design merges narrow and wide bandwidth technology capable of digital, coded voice and data transmission, including a VHF/UHF-capable transceiver to interface with an existing leaky feeder network.

Batteries used in underground coal mines for use in emergency conditions must be intrinsically safe and not capable of supplying more than 0.25 millijoule of energy when the battery terminals are shorted together. This requires an MSHA-approved current trip printed wiring board, see U.S. Pat. No. 5,301,052, issued Apr. 5, 1994.

The electronic design world has changed with the advent of the digital telecommunications networks and cell phones. Today engineering designs are based on field-programmable gate arrays (FPGA) interconnected to microcontrollers and gigabit memory. The design must be reprogrammable with in-application programming (IAP). This have is built into the design of the software-definable transceiver (SDT) employed throughout the transceivers.

Each of the SDT transceivers in the transceiver cap-lamp battery and F1/F1 repeaters is a mesh network component. The F1/F1 repeaters serve as Access Points (nodes) within the network and the cap-lamp transceivers connect through the Access Points. The Bluetooth protocol is used within the transceivers to communicate with other devices used in the remote control equipment and environmental monitoring at designated points in the coal mine.

Figure 10:
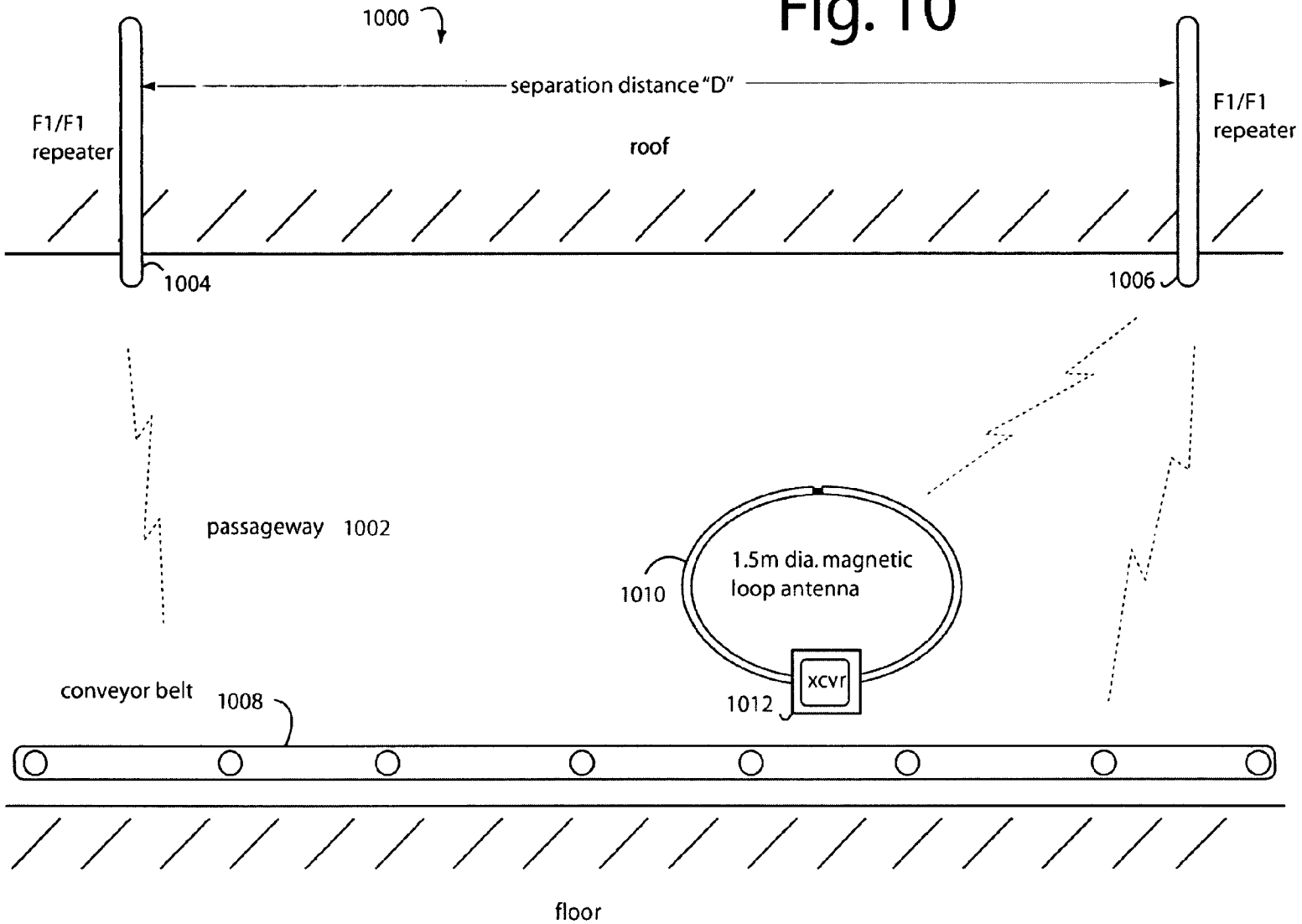
FIG. 10 is a side view cutaway diagram representing a mine with a passageway and F1/F1 repeaters mounted in the ceilings.

FIG. 10 represents a mine 1000 with a passageway 1002 and F1/F1 repeaters 1004 and 1006 mounted in the ceilings. The F1/F1 repeaters 1004 and 1006 operate in the LF (30-300 kHz) band, and carry the network transmission messages for the system network. They are separated by a distance (D). Multiple F1/F1 networks can be overlaid in an underground mine. The F1/F1 repeater housings are cylindrical and holes can easily be drilled into the roof rock for them. MSHA approved flame proof enclosures enable operation following an event.

The F1/F1 repeater transmitters generate EM waves with an electric field component $E_{100}$, that illuminates, e.g., a conveyor belt structure 1008. An electrical current induces too in any other existing conductors, e.g., yellow CAT lifeline, nearby steel cables, three-phase power cables, leaky feeder cable, telephone lines, etc. The induced current flow creates a secondary EM field with the magnetic component H shown in FIG. 10. Either a cap-lamp transceiver or another F1/F1 repeater can receives the message (see Equation 1-41) at nodes in the mesh network. In many situations, the nodes are distributed along the guide wire waveguide. A 1.5 meter diameter magnetic loop antenna 1010 and transceiver 1012 in protective sheathings and enclosures are shown for example.

The maximum separation distance (D) between repeaters shown in FIG. 10 can be derived theoretically. Alternatively, a few measured data acquired in a conductor-less underground passageway can be used to determine the important system parameters. The transmitter coupling to the transmission waveguide is dependent on transmitter magnetic moment (M) as 20 $\text{Log}_{10}$M. The attenuation rate through the waveguide is determined by the slope of a graphically constructed line. The RFI noise for the waveguide is measured by the system receiver. Then, the spreading factor for the waveguide can be applied to the data.

The separation distance (D) can be determined from a graphical construction. The distance (D) is reduced because of insertion losses at belt transfer points and power centers. This loss lowers the constructed linear line by the loss decibel amount. Each power center adds attenuation to the network.

In entries without electrical conductors, a yellow CAT lifeline guide-wire waveguide can be installed by draping it from hooks in the walls or ceilings. The conductor/lifeline waveguide is constructed by hanging a yellow CAT cable from roof bolt hangers. A disposable yellow CAT cable typically weighs 26 pounds/1,000 feet. Such cable has a very low-attenuation-rate for the Hill-Wait bifilar mode of guide-wire waveguide EM wave propagation.

A lifeline guide wire includes at least two insulated copper conductor and a multi-strand steel cable or Kevlar core with an MSHA-approved yellow cover. If it is ever accidentally cut, the yellow CAT cable can be simply reconnected to restore the waveguide. Each yellow CAT cable can be inductively coupled to a power cable or conveyor belt, for example, by continuing the cable for at least 150-feet along a three-phase power cable. No contact connection to any other cable is required, and the coupling loss is 8-dB. Installing a companion repeater on the surface, can establish an emergency transmission through-the-earth link.

Through-the-earth (TTE) communications of over 900-feet was demonstrated at Consol Energy's Leverage Coal Mine. Using a 2,000-Hz F1/F1 repeater and a surface EM-Gradiometer, a simulated trapped miner was located using a grid search procedure. The 2,000-Hz F1/F1 repeater provides TTE text messaging.

The development of coal mine entries is followed by the movement of the power center to just toward the mine entrance (outby) the last open crosscut. The working face is close enough to the F1/F1 repeater located at the power center to provide high-quality emergency and operational radio coverage in the working area. From this location, the F1/F1 repeater batteries can be trickle charged. When ventilation is shut down, the F1/F1 repeater remains operational using power from an MSHA approved intrinsically safe battery.

The strength of a resonant magnetic dipole radiating fields depends on the magnetic moment, which rapidly increases with the square of its radius. A factor of one hundred (e.g., 40-dB) increase can be achieved with a large-diameter resonant loop antenna located with the power center. The loop antenna and 2000-Hz F1/F1 repeater can be detached from the power center as miners retreat to the tent in a rescue location. By transmitting at 2000 Hz, the cap-lamp transceiver can communicate text messages through the 2000-Hz F1/F1 repeater to the surface.

The F1/F1 transceiver includes an in-application programmable (IAP) software-definable transceiver (SDT) design to enable remote reprogramming of the frequency synthesizer for generation and superheterodyne reception of the narrow-band radio frequency signals. Reprogramming is achieved with a personal data assistant (PDA). The repeater's transmitter and receiver operate with the same carrier frequency. Any carrier frequency in the LF band can be used for any of the F1/F1 overlay mesh networks. The F1/F1 operational capability enables each transceiver to receive and decode the digital signal and, with a time-delay, retransmit of the received signal. A significant advantage of an F1/F1 repeater is the requirement of only a single antenna, eliminating the need for four antennas at each repeater site as was necessary in the original UPL mine-wide wireless network.

The transmit magnetic moment (M) is not restricted because coil conductors, resonating capacitors, digital core (SDT) electronics and intrinsically safe batteries are completely enclosed in a flame proof enclosure. The batteries are trickle charged through MSHA approved packing gland. A summary of the EM characteristics of a mine-wide F1/F1 network is given in Table 2-2.

TABLE 2-2

Summary of the EM Characteristics of a Mine-Wide F1/F1 Network.

Natural waveguides already exist in a coal mine:
Through-the-earth waveguide mode
Conveyor belt structure or cable guide-wire waveguide mode
Coal seam waveguide mode
Passageway waveguide mode Cap-lamp transceiver to network coupling is made by the electric field component ($E_\phi$) of the EM wave as shown in Equation (2-1).

Roving transceivers should employ a vertical magnetic dipole (VMD) antenna for maximum coupling to the network.

In the low frequency band (30-300-kHz), the bifilar guide-wire waveguide attenuation rate is extremely low.

Because of electrical noise generated in mine power systems, the F1/F1 network should be operated above 100-kHz.

Cap-lamp transceiver coupling to the conductor/Life Line waveguide increases with frequency as suggested by Equation (1-29). However, the current induced in the conductor/Life Line waveguide exhibits an inverse frequency relationship, as shown in Equation 2-1. There is a zero-effect tradeoff. Another factor is shown in Equation 1-10, which illustrates yet another frequency (ω) dependence, which causes the receivers to be more efficient at higher frequencies. This condition, together with the electrical noise spectrum decreasing with frequency, makes the case for F1/F1 transmission system operation in the upper low-frequency band.

TABLE 2-2-continued

Summary of the EM Characteristics of a Mine-Wide F1/F1 Network.

Network repeaters should be separated by a minimum distance to ensure that the destination signal-to-noise ratio is at least 40-dB.

Transformers in power cables attenuate the signal by 12 to 14-dB.

Standing waves would exist except for multiple reflections caused by multiple electrical conductors.

Signals couple to other electrical conductors by induction. Separate conductors paralleling one another for at least 150 feet couple with a loss of 8-dB.

Specifications For F1/F1 Repeater

The F1/F1 repeater operating frequencies

Repeater frequency is tunable from DPA via Bluetooth link to each frequency-FSK transmission

| Emergency Frequency | 2000 Hz | Q = 20 80 bits per second |
|---|---|---|
| Frequency($f_o$) | 200-kHz<br>225-kHz<br>250-kHz<br>275-kHz<br>300-kHz | Q = 50 Bandwidth (BW) = $\frac{f_o}{Q}$<br>4800 bits, per second |

1-inch diameter ferrite with material selected for highest unloaded Q-2 foot long.

Text message capability by transmission of English letters and numbers with error check. Appended with F1/F1 ID, time stamp, storage of last messages, if message received once, not resend to prevent transmission network lock-up.

Receiver input impedance z = 50 ohms

Receiver sensitivity $s^{20} = 166.8 + 10 \log_{10} BW + 10 \log_{10} NF\ dB_m$

FSK of carrier for transmission of text message and digital voice

Class L amplifier

RIM rechargeable battery pack with MSHA intrinsically safe certified current trip PC provided by Stolar 1.661-inch OD stainless steel enclosure with Stolar mating connection and MSHA approved flame proof enclosures (Stolar drawing no.)

Antenna enclosures design

F1/F1 transceiver and antenna installed in MSHA approved flame proof enclosures. Internal intrinsically safe battery protected by MSHA approved current trip PCB and trickle charged from mine power.

In coal mine communications, mine-wide coverage requires propagation through natural media (e.g., sedimentary rock or coal. Natural waveguides exist in layered deposits and the infrastructure of an underground mining complex, including: Ionosphere-earth waveguide; Through-the-earth waveguide (TTEW); Conductor/lifeline waveguide (CLLW); Coal seam waveguide (CSW), and Tunnel waveguide (UHF/fiber optics).

Mining and roof falls release methane, so radio communications and tracking equipment must be intrinsically safe and designed to meet RFI emissions regulations.

Cap-lamp transceivers must operate within the 0.25-millijoule explosive methane limit, as defined by Underwriters Laboratory Publication 913. Using much higher magnetic moments requires flame proof enclosures for the radiating magnetic dipole antenna structure.

Magnetic dipole antennas exhibit imaginary near-field impedance and electric dipoles exhibit real impedance. Energy is stored in the near-field field of a magnetic dipole and dissipated in the case of an electric dipole. The stored energy in the near field of the magnetic dipoles is available radiation into the natural media.

Signal coupling to the conductor/lifeline waveguide (CLLW) is by the electric field component of the electromagnetic wave radiating from the magnetic dipole antenna. A roaming miner requires a vertical magnetic dipole integrated inside the cap-lamp transceiver to efficiently couple to the CLLW. A horizontal magnetic dipole efficiently couples to the CSW waveguide.

The signal coupling from the conductor/lifeline waveguide to a receiving vertical magnetic dipole is effectuated by the magnetic field component of a radiating electromagnetic wave radiating from the conductor/lifeline waveguide.

Narrow bandwidth (BW) operation is a requirement in emergency communications and tracking systems. The magnitude of the electric and magnetic field components of the electromagnetic wave radiating from a magnetic dipole are directly proportional to the magnetic moment (M) vectors given by, $$M = NIA \text{ ampere turn per square meter,} \tag{3-1}$$

where N=number of turns of wire used in building the antenna,

I=circulating current in amperes at resonance, and

A=the area vector normal to the loop with a magnitude equal to the loop area in square meters.

At resonance, the EMF induced in the receiving magnetic dipole antenna is multiplied by $Q_{CKT}$. The equivalent resistance in series with the coil is multiplied by $Q^2$. If placed across a parallel resonant magnetic dipole equivalent circuit. Resonant magnetic dipoles circulating current is the product of induced current and the quality factor (Q) given by, $$Q_{CKT} = \frac{f_o}{BW}, \tag{3-2}$$

where $f_o$ is the resonant frequency in Hertz.

Using the definition of Q and the peak energy stored in the magnetic dipole, the magnetic moment is dependent on bandwidth as $$M = \sqrt{\left(\frac{lA}{\pi\mu}\right)\frac{P_d}{BW}}, \tag{3-3}$$

where $P_d$ is the power dissipated (applied) in the magnetic dipole and BW is the 3-dB bandwidth of the antenna circuit.

To maximize the magnetic moment, the bandwidth must be minimized.

Cap-lamp transmit or amplifier power has to be limited for intrinsic safety considerations. Thus the only option left to increase the communication distance is to increase receiver detection sensitivity. The receiver sensitivity for 20-dB 10-dB signal-to-noise ratio is, $$S^{20} = -166.8 + 10 \log_{10} BW + 10 \log_{10} NF \text{ dBm} \tag{3-4}$$

where $10 \log_{10}$ NF is near 1.5.

The bandwidth must be minimized and not maximized as is the goal of modern-day communications technology.

Transmitters and radiating magnetic dipole enclosed in MSHA approved flame proof structures with trickle charged intrinsically safe battery protection circuits have no magnetic moment restrictions except a standby-transmit cycle time of forty-eight hours.

The MINER Act of 2006 requires a lifeline in escapeways with direction-out indicators. In the bifilar mode, EM wave propagation losses along a two-conductor guide-wave waveguide are only 1-dB per 1,000 meters. So a lifeline built with a multi-strand steel core and insulated copper wire can provide lost-cost communications to roaming miners in every entry. The lifeline is easy to extend in a developing mine. If broken, it can be easily reconnected.

Fox hunter antennas are compound electric and resonant magnetic dipoles that can double coverage in the work face area, compared to a single magnetic dipole. Operational communications and tracking require wideband transmission. Narrow and wide bandwidth transmission can be supported by integrating fiber optic cable in the yellow CAT life line installed in man and material entries.

In general, the signal transmission distance through natural media such as coal and sedimentary rock is severely limited. Linking natural and mining complex infrastructure waveguides together for digital data transmission requires the integration of both narrow and wide bandwidth transceivers in a network. These waveguides can be exploited to extend the otherwise limited communications range. Even though each waveguide individually has its own distance limitations. For example, radio frequency interference (RFI) limits the intelligible communications distance in each waveguide, which is, in general, an inverse function of the radio interference frequency. Because mine disasters commonly disrupt the fresh air-flow system, a properly designed radio communications and tracking system must have intrinsically safe batteries to remain operational when ventilation is disrupted. The entire design must be intrinsically safe if not enclosed in an MSHA approved flame proof enclosure.

A system installed in a coal mine can operate in five natural and redundant electromagnetic (EM) wave transmission modes and frequency bands: Ionosphere-earth waveguide (RF bands); Through-the-earth (TTE) waveguide (ULF band); Conductor/lifeline guide-wire waveguide (LF band); Coal seam waveguide (LF band); and, Passageway leaky feeder EM fiber optic waveguide (VHF/UHF bands band). Switching among ULF, LF, VHF, and UHF bands is what requires the use of a software defined radio (SDR) and a field programmable gate array (FPGA).

Since the digital data bit rates are limited by the carriers, the data rates are a few Hertz per second in the ULF band, and rise to a few kilohertz per second in the LF and MF bands. The bit rate in fiber optics transmission can, of course, be gigabits per second.

systems must comply with United States Mine Safety and Health Administration (MSHA) regulations, and other provisions like the MINER Act. These dictate intrinsically safe operation and other requirements.

Figure 11:
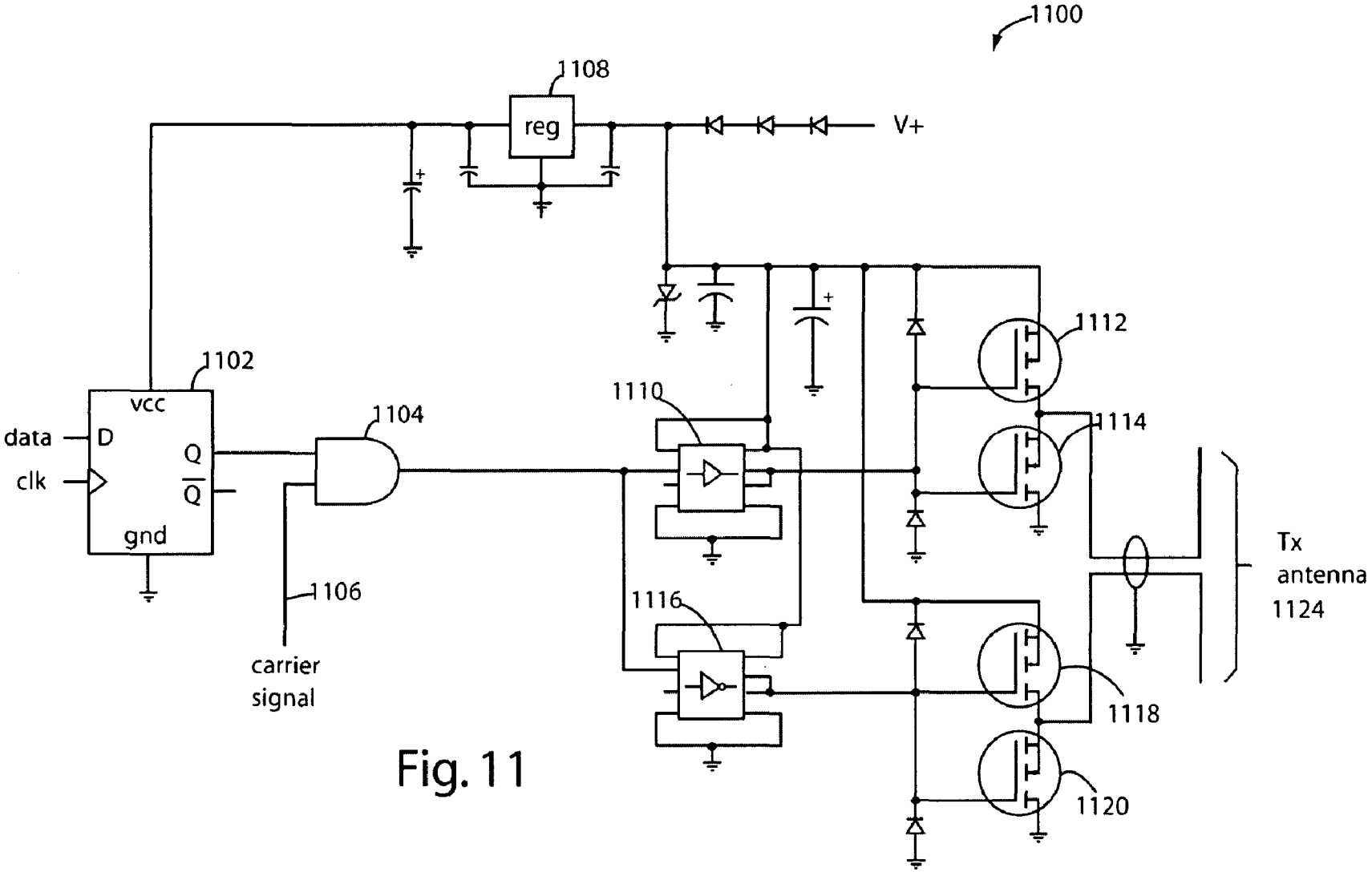
FIG. 11 is a schematic diagram of a Class-L power output amplifier.

In FIG. 11, a Class-L power output amplifier 1100 comprises a balanced radio power output that differentially drives a dipole antenna or other balanced load. One half of the differential power output drives one side of the antenna from ground to the maximum positive rail, while the other half of the differential power output drives the opposite side of the antenna from the maximum positive rail to the ground. The result is a voltage swing across the antenna twice that which would occur if a single-ended output were driving an unbalanced load. Because the power output is the square of the voltage divided by the load impedance, four times the power can be output to the antenna.

Class-L amplifier 1100 has a D-type flip-flop 1102 that accepts data input modulation and clocks, a logic AND-gate 1104 for gating through a radio carrier input 1106 according to the modulation, and a three-terminal voltage regulator 1108 that provides operating power to the digital logic. A MOSFET-driver 1110 drives a totem-pole arrangement of two power MOSFET's 1112 and 1114. An inverting MOSFET-driver 1116 drives another totem-pole arrangement of two power MOSFET's 1118 and 1120. Taken altogether, the MOSFET-drivers and the four MOSFET's implement a digital, differential drive radio power output. A balanced transmission line 1122 connects the output to an antenna 1124.

In one implementation that worked well, the MOSFET-driver 1110 was a Maxim Integrated Products (Sunnyvale, Calif.) MAX4420CSA, the inverting MOSFET-driver 1116 was a MAX4429CSA, the MOSFET's 1112 and 1118 were International Rectifier (El Segundo, Calif.) IRF9540N HEXFET Power MOSFET's, and the MOSFET's 1114 and 1120 were IFR640 HEXFET Power MOSFET's.

In many applications, the V+ power rail will be directly connected to a battery, e.g., 6-volts or 112-volts. The differential output drive of amplifier 1100 results in twice the voltage swing at antenna 1124 than would otherwise be possible with a single-ended output. The power output is therefore increased as the square of the voltage, divided by the load impedance. On one-half of each carrier cycle, the top dipole part of the antenna will be V+ relative to the bottom dipole part. On the next one-half of the carrier cycle, the top dipole part of the antenna will be −(V+) relative to the bottom dipole part. The peak-to-peak swing is therefore 2*(V+).

Figure 12:
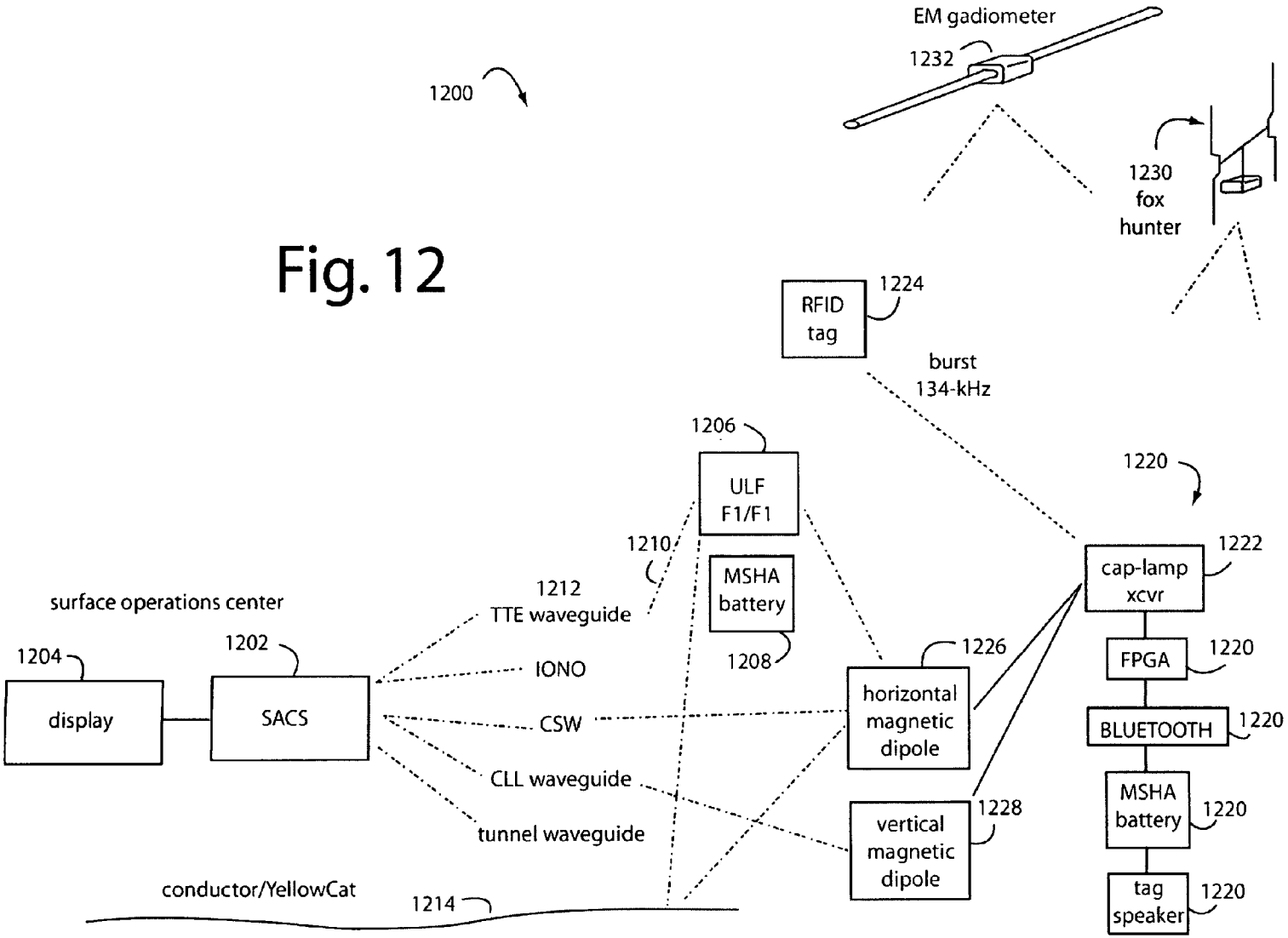
FIG. 12 is functional block diagram of an underground radio communications and personnel tracking system embodiment of the present invention.

FIG. 12 represents a system 1200 to provide communications and tracking capabilities in a highly redundant, self-healing, and reliable manner. Each system 1200 includes a situation awareness computer system (SACS) 1202 with a graphical display 1204, flame proof F1/F1 repeater transceivers 1206 with MSHA approved intrinsically safe batteries 1208 for narrow bandwidth transmission 1210 in the through-the-earth 1212 and conductor/yellow CAT wave guide 1214. The F1/F1 repeater transceivers 1206 provides bidirectional redundant paths from the end of a development entry power center or a rescue center to the surface.

A multi-network cap-lamp 1220 includes a multi-mode transceiver 1222 for voice, synthetic voice, and text messaging for roaming miners and mine rescue teams and communications with passive RFID tags. Passive RFID tags 1224 are placed in all the mine entries. A high-power class-L radio frequency amplifier drives resonant magnetic dipole antennas 1226 and 1228. A directional fox hunter antenna 1230 for use by mine rescue teams can be used to determine the location of miners wearing cap-lamp 1210 when trapped within a mining complex. High power magnetic dipole antenna flame proof enclosures are used with a wireless bi-directional, self-healing, mesh network constructed with F1/F1 repeaters 1206.

A typical mine will be equipped with conveyor belt, power cables, rails, and yellow CAT lifelines that are serendipitously employed in the leaky feeder tunnel waveguide modes. Yellow CAT lifeline cable 1214 further includes a wideband fiber optic transmission network. A multi-functional personal data assistant (PDA) 1232 has a MSHA approved flame proof enclosure and intrinsically safe battery with IEEE 802.115 electronics for fiber optic termination. A EM-Gradiometer 1242 is used on the surface, or flown over the surface, to take measurements that can be used to zero-in on the underground location of trapped miners below.

The tracking or locating of miners roaming or barricaded in a very large underground mining complex requires intrinsically safe hardware that can be safely used in an operating coal mine. In the system 1200, tracking and determining a roaming miners' locations is implemented with two redundant methods.

One method of tracking and locating depends on a cap-lamp battery or self-contained self-rescuer with an intrinsically safe, battery-powered tracking beacon operating in the TTE mode. Each cap-lamp transceiver 1222 can transmit coded two-way text messages through the earth to an EM-Gradiometer 1232 deployed on the surface. Tracking beacon and cap-lamp transmission antennas can be vertical magnetic dipole (VMD) 1228 or horizontal magnetic dipole (HMD) 1226 ferrite rod antennas.

A second method places passive RFID tags 1224 in all entries to provide location, identification, and time stamp data for cap-lamp transceiver 1222 transmissions via networks of F1/F1 repeaters 1206.

A tracking beacon was developed with a text messaging display and keyboard. Tracking beacons can be carried by a roaming miner, or the tracking beacons can be stored with emergency supplies.

Batteries, even if installed in MSHA flameproof enclosures, must be intrinsically safe at their terminals or all power must be turned off in potentially explosive atmospheres. Shorting the terminals must not exceed the methane explosive limit of 0.25 millijoule. Batteries used in the communications and tracking networks must either meet the intrinsic safety certification approval, or be removed from non-ventilated sections of the coal mine.

F1/F1 repeaters 1206 include O-rings in 1.661-inch-outside-dimension stainless steel tubes, allowing the repeaters to withstand 5,000 feet of immersion into NQ (76-mm size) boreholes. The ferrite rod antennas are sealed in fiberglass tubes with the same immersion capability.

Another system used to locate trapped miners for use during in-mine rescue operations is a so-called Fox Hunter Antenna 1230 carried by the rescue team. This device is a directional antenna designed to produce maximum response when pointed at a trapped miner's cap-lamp transceiver 1314. The fox hunter antenna 1230 equipped with a transceiver would also be capable of two-way text messaging with the miners.

An fox hunter antenna is constructed with a horizontal magnetic dipole (HMD) and a vertical electric dipole (VED). The antenna can be carried by the mine rescue team to determine the direction of a trapped miner. The fox hunter antenna technology is incorporated into the system as one of the tracking and communication modes.

multiple F1/F1 transmission networks are preferably overlayed and installed as a mining complex is developed. The transmission network utilizes F1/F1 repeaters 1206 as a assortment of Access Points to construct a wireless network. Each time a radio transmission from a roaming miner with a beacon or cap-lamp transceiver 1222 accesses a nearby F1/F1 repeater 1206, a corresponding location ID is attached to a message sent to the SACS 1202 in the surface operations center. Each time a roaming miner passes by an RFID tag 1224, more tracking information is sent to the SACS 12302. Computer-generated information, an EM-Gradiometer 1232, or an fox hunter antenna 1230 can then be used to pinpoint every miner's location.

A time slot reporting scheme can be used if receiving simultaneously transmissions from multiple transmitters becomes a problem. Or in a collision avoidance scheme, the transceiver would turn on random intervals, and transmit a digitized encoded signal and repeat that three to five times. Each message would include both the transceiver identification number and a code.

In one embodiment of an underground dithered transmission system, the F1/F1 repeaters 1206 operate in the LF (30-300-kHz) band, modulated with the network transmission message, are employed as part of the system network. The F1/F1 repeaters 1206 are packaged in long, thin cylindrical housings and can easily be inserted into holes drilled into the roof rock. The associated F1/F1 repeater transceiver and antennas are protected in MSHA approved flame proof enclosures.

A random dithering of transmissions in an F1/F1 repeater network is incorporated into the system. Vocoder processing enables the generation of a very narrow band voice signal, which allows resonant magnetic dipole antennas to develop a very high magnetic moment while conserving transit power.

Each roaming miner with a two-way communications device has a rugged cap-lamp transceiver that sends and receives digital vocoder voice, text messages, and synthetic voice communications. The message structure is shown in Table 4-1.

TABLE 4-1

F1/F1 Repeater System Message Structure.

| SYNC[1] | MESS ID[2] | To Unit ID[3] | First Relay ID[4] | Message[5] |
|---|---|---|---|---|

[1]Sync is the pattern the relay needs to obtain bit and frame synchronization. Transmission is frequency shift key so no carrier synchronization is required, but the design provides good frequency accuracy so frequency shift key is decoded with near matched filter performance.
[2]MESS ID provides a unique message number so that a relay can tell if this message has been received and processed before. The MESS ID consists of the Unit ID and a message count modulo of 256, assuming that no unit transmit more than 256 messages in a short time frame. At the receiving end, the Unit ID identifies which unit sent the message and provides a crude tracking capability.
[3]To Unit ID is the ID of the unit to which the message is addressed. An all-zero address is broadcast to everyone (e.g., a help message).
[4]First Relay ID is a field that is zero when the user unit transmits a message, but it is filled in by the address of the first relay to forward the message. This capability provides a way of locating the unit/roaming miner in a crude way within the mine to help define a fine search on the surface, if needed.
[5]Message is either a number that is a pre-prepared message like "help" or an alphanumeric message typed on the keypad of the miner's unit.

F1/F1 repeater relay transceivers are placed throughout the mine without restrictions on their layout except that every part of the mine must be covered by at least one relay transceiver. That way, every roaming miner will always be within reach of a relay transceiver. Each relay transceiver must also be in contact with at least one other F1/F1 repeater relay transceiver, making a fully inter-connected network.

The network can be self-organizing as long as the network is connected by sending each message through each relay transceiver exactly once. For example, in network parlance, this condition is known as "flooding" or "routing by flooding". This ensures that every message is propagated to every area of the mine including the portal. The network does not oscillate from looping messages because each F1/F1 repeater relay transceiver propagates each message only once.

To prevent two relay transceivers near each other from becoming jammed, a random time delay between receiving and transmitting (e.g., dithering) and carrier sense multiple access (CSMA) are incorporated. In this way, if two relay transceivers within range of each other receive a message at the same time, one transceiver start to resend the message first and that relay transceiver continue until the message is complete without being jammed by the second relay transceiver. If some F1/F1 repeater relay transceivers are not within range of each other, simultaneous messages can be relayed by both, which provides some frequency reuse and increases the capacity somewhat.

Figure 14:
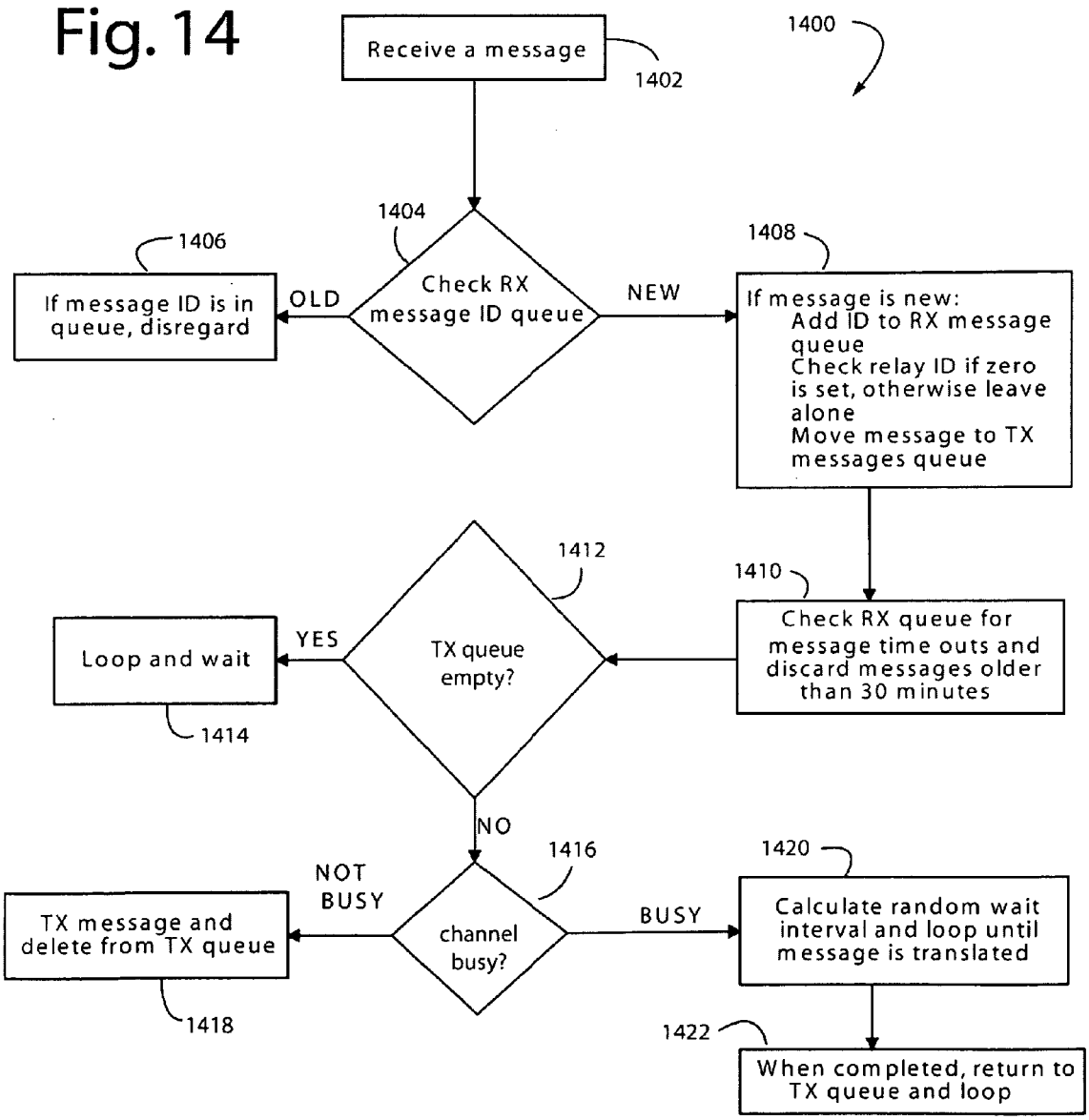
FIG. 14 is a flowchart diagram of an F1/F1 repeater method embodiment of the present invention.

A relay message processing method 1400 for the F1/F1 repeaters is diagrammed in FIG. 14. When a message is received in a step 1402, a step 1404 checks to see if the message ID is in the receiver queue. If so, the message is old and have already been relayed, it can be disregarded in a step 1406. Otherwise, it's a new message not seen before, and a step 1408 adds the ID to the queue, and relays it to the transmitter. A step 1410 discards messages older than 30-minutes. A step 1412 checks the transmitter queue. If empty, a step loops and waits. Otherwise, a step 1416 sees if the F1-channel is busy. If not busy, a step 1418 transmits the message and deletes it from the transmit queue. Otherwise, if busy, a step 1420 calculates a random wait to try again later. A step 1422 transmits the message after the random wait.

The proper design of a F1/F1 repeater network with multiple relay transceivers involves several engineering challenges. Network flooding where the forwarding by a router of a packet from any node to every other node attached to the router is too inefficient, so the network capacity that is sufficient for the task at hand must be the target. Maximizing the bit rates can avoid this potential limitation. Employing a network simulator during the network design phase enable the capacity of the network relative to requirements to be analyzed and optimized. In a large mine, many relays be required making the associated messaging delays very substantial. A network simulator can allow a careful analysis and minimizing of delay. In a very large mine, sub-networks using flooding could be employed, with the sub-networks connected via gateways or bridges to increase capacity and reduce delay.

To achieve face area coverage (e.g., short-term connectivity), the power center toward the mine entrance (outby) and the last open crosscut is the preferred location for the MSHA approved flame proof F1/F1 repeater transceiver with a 1.5 meter diameter loop antenna. At this location, a loop antenna (horizontal magnetic dipole) and F1/F1 repeater transceiver move with the power center. The F1/F1 repeater transceiver antenna provide two-way voice and data communications throughout the face area. The F1/F1 repeater transceiver intrinsically safe battery be trickle charged from the power center.

F1/F1 transmission networks add message delays and latencies that double when passing through each repeater onto a destination. The digital bit rate, or effective bandwidth, is cut in half by each repeater. The effective bit rate (EBR) at destination is mathematically represented by, $$BER = \frac{\text{encoding bit rate}}{2^n} \quad (1-$$

where, n is the number of repeaters along the transmission path to destination.

The relatively low attenuation rate of Yellow CAT conductor/Life Line waveguides (1-3-dB per km at 200-kHz) sets the transmission distance between F1/F1 repeater transceivers to something in excess of 60,000 ft (11.4 miles), where destination S/N>40-dB. In contrast, electric power line transmissions of LF line carrier signals are routinely used to control and monitor substations more than one hundred miles distant.

Pace or refuse chamber communications require one F1/F1 repeater cutting the affected bit rate to 2400 bits per second. Transceiver embodiments can further include two-way Bluetooth RF modems to communicate with a hand-held personal digital assistants (PDA). The PDA's transmit foreman's reports to the surface operations center, display the mine map with locations of miners and mine assets updated through the 200-kHz tracking F1/F1 network, and reprogramming of the transceivers. The mine map loaded into the PDA can be updated at the surface through the SACS. F1/F1 repeater transceivers include self-diagnostic monitoring and control software algorithms designed to download from and to a field-programmable, gate array (FPGA), digital signal processor (DSP), PDA, and microcontroller. A Bluetooth RF modem two-way data link enables each PDA to set up the F1/F1 repeater control parameters, determine operational status, and fog stored data. The PDA also be useful in training maintenance personnel and troubleshooting the system.

The MINER Act requires that a secure communications link be established with MSHA headquarters and MSHA-specified locations to comply with the 15-minute advisory of an incident. In order to ensure operation of this communications link following an event, surface wireless communications may need to be squelched during the incident. For example, personal cell phones operating in the near the portal region during the Sago search and rescue time period were the source of much confusion.

The F1/F1 repeater and cap-lamp battery transceivers include Bluetooth ports enabling remote monitoring sensors to easily interface with repeaters and cap-lamp battery transceivers. The technology can be used to remotely control devices in the mine. The monitoring data appear on the graphical display employed in the SACS installed in the surface operations center.

In alternative embodiments, a tracking beacon or transceiver can be attached to a self-contained self-rescuer (SCSR) and stashed in a refuse for a trapped miner. A surface transceiver is used for two-way communication. Mine rescue teams would be able to use the directional fox hunter antenna to locate and communicate with the trapped miners.

The system, comprising a wireless tracking system and a wireless two-way communications system, is designed for used in mine emergencies. If the system fails during an emergency, the consequences could be dire. Therefore, the system must be tested at regular intervals to ensure proper functioning. Self-checking software in the transceiver FPGAs interface with the surface computer so that locations of failure be documented at the surface network computer. An operator's manual accompanying each system include a test procedure to be followed to ensure that the equipment continues to perform properly. In addition, Stolar may make available to purchasers of a system a maintenance program under separate contract through which Stolar periodically validate the system's operation for the mining company.

A yellow CAT lifeline with a multi-strand steel wire or Kevlar core and at least two parallel insulated copper wire support monofilar and bifilar coupling and transmission in the entries without installed an electronic conductive rails or conveyor belts or power cables. Going left to right across the audit entries 1, 2, 3, 6, 7, and 8, yellow cat lifelines be installed through each of these entries to the developing face. The yellow CAT-FO2 be installed in the man and material (conveyor belt) entries. Alternatively, the yellow CAT lifeline could be looped around the pillars between entries 2 and 3 as well as entries 7 and 8. Yellow CAT cable can be branched into the first development entries. The F1/F1 repeaters are installed in 2-inch diameter roof boreholes. Some F1/F1 repeaters are moved with the power centers when they move. The F1/F1 repeaters at each power center have large-diameter resonant loop antennas mounted on ribs and stopping walls. They are detachable from the repeaters mounted on the power center. Such repeaters are advanced with the developing face. The repeaters enable overlay of a distributed mesh networks: tracking all-call (paging) and gas monitoring communication (200-khz); supervisor-to-supervisor voice (225-khz); maintenance-to-maintenance voice (250-khz); environmental monitoring (275-khz); and VHF/UHF leaky feeder on fiber optics.

The cap-lamp software-definable transceiver (SDT) 1314 (FIG. 13) provides voice and data communication with each of the (LF/MF) conductor/Life Line, through the earth at 2000 Hz, coal seam waveguides, and the UHF leaky feeder voice and wide band fiber optic (FO) facilities. Yellow CAT-FO2 life line cable 1214 (FIG. 12) supports: Hill-Wait bifilar transmission modes and the fiber optics are used for wide bandwidth optical transmission; low-frequency induction mode communication using an installed conveyor rail as power distribution cable and yellow CAT lifeline waveguide; low-frequency coal seam mode communication through the coal seam (2,000 feet); ultra low frequency (ULF) through-the-earth two-way text messaging with EM-Gradiometer; and, tracking using passive RFID tags 1224 and the SACS 1202 (FIG. 12).

Environmental monitoring sensors, health sensors, and PDAs (e.g., Blackberries) can communicate with F1/F1 repeaters and cap-lamp transceivers via Bluetooth transmissions. The SACS 1202 enable real-time tracking of mine personnel and vehicles tagged by special icons on the graphics display 1204. The surface operations center include a secure Internet voice and data link to MSHA head-quarters and the regional office.

The working faces are provided with radio service using tuned-loop antennas operating at 200-kHz, 225-kHz, and 250-kHz. These antennas are typically mounted with F1/F1 repeaters on the outby power center. The mine's development power center be equipped the same way.

In emergencies, the cap-lamp transceiver communicates text messages (80 Hz bit rate) by transmission with the 2,000-Hz resonant loop antenna and F1/F1 repeater. The F1/F1 repeater provides a redundant transmission link through the earth to the surface EM-Gradiometer. After each power center move, a communications check confirm operational readiness. The emergency communications system can be taken with the face crew when they depart to the rescue tent. The emergency and operations system can be permanently installed at the rescue location.

Designated rescue stations be equipped with additional tracking LCDs and multi-network transceivers. A surface EM-Gradiometer and through-the-earth 500-Hz repeaters be provided to the mine.

A radio communications and tracking system cap-lamp transceiver integrates a software-definable transceiver (SDT), Class L transmitters, a VHF/UHF analog FM transceiver, intrinsically safe battery pack, a light-emitting diode (LED) lamp, a detachable touchscreen/speaker/microphone, a Bluetooth port, and a text messaging display and quadrature array of two resonant magnetic dipole antennas. A wideband UHF antenna enables analog to leaky feeder cable and fiber optic node bi-directional communications. All subsystems when interconnected and functional create intrinsically safe or flame proof device.

Each cap-lamp transceiver provides two-way text messaging in through-the-earth transmission with the text messaging capability included in all waveguide transmission and fiber optic cable nodes. Some cap-lamp transceivers use frequency shift key (FSK) modulation in all waveguide transmissions. Analog FM modulated enables communication with leaky feeder cable.

The cap-lamp transceiver periodically illuminates the local passive radio frequency identification (RFID) tag. The RFID tag return signal is received and processed to determine a corresponding location in the mining complex.

The cap-lamp transceiver initiates dithered transmission of location, time stamp, cap-lamp identification, and travel direction on the tracking frequency (200-kHz). Location transmission terminates with an F1/F1 repeater receipt confirmation.

Cap-lamp transceivers' typical operating frequencies are: RFID tag, 134.2-kHz; Tracking/all call (paging)/monitoring and through-the-earth via ULF transceiver, 200-kHz; Supervisor, 225-kHz; Maintenance, 250-kHz; Environmental monitoring, 275-kHz VHF/UHF; and leaky feeder FO node.

Yellow-covered cable supporting the Hill-Wait monofilar and bifilar modes of transmission are fabricated with a multi-strand steel cable or Kevlar multiple strands of stainless steal core and at least two 16-gauge insulated copper conductor wire. The cable includes multicore fiber optics. These cables are for installation in man and material entries of mines. The cable design includes molded way-out Braille indicators with passive RFID tags. The yellow cover is reflective, and the stainless steel strands enable the cable to be tied in a knot to restore transmission.

The cable is installed at mid height of the rib in all entries so as to construct a closed loop. Each pair of parallel entries forms a separate closed loop. The extreme ends of the loop are electrically connected together to form a mesh bi-directional transmission network.

The radiating vertical magnetic dipole (VMD) in the cap-lamp battery enclosure creates a horizontally polarized electric field component that induces monofilar current flow in the installed conductor/lifeline cable. The orientation of the radiating VMD induces much lower current in the roof electrical conductors. Few dead spots will thus occur when traveling in the mine entries.

F1/F1 repeaters integrate software-definable transceiver (SDT), Class L transceiver, intrinsically safe battery pack, Bluetooth port and magnetic dipole antenna. The repeater intrinsically safe battery is trickle charged from the mine section power center and two insulated copper conductors in the Lifeline cable. A ventilation failure and loss of mine power automatically switches each F1/F1 repeater to internal intrinsically safe battery, e.g., with at least a 40-hour, 10/90 endurance capability.

The F1/F1 repeater requires only a single magnetic dipole, which is an advantage over conventional F2/F1 repeater designs that require two operational antennas to provide local area coverage, and more over F2/F1/F4/F3 repeaters that require four separate antennas to provide chain repeater coverage.

A cylindrical enclosure for each F1/F1 repeater is inserted into a two inch diameter vertical roof borehole. The configuration hardens the repeater against catastrophic events. The VMD antenna of the F1/F1 repeater generates horizontal electric field components to efficiently couple to the conductor/lifeline waveguide.

The 2000 Hz F1/F1 repeater and magnetic dipole antenna enclosed in a flame proof enclosure. The magnetic dipole is enclosed by a MSHA approved hydraulic hose that forms an electric shield for the loop antenna. The ends of the loop antenna enter the flame proof enclosure through MSHA approved packing gland. The 2000 Hz F1/F1 repeater flame proof antenna is deployed as a vertical magnetic dipole (horizontal plane) for mine entries less than one skin depth deep. The flame proof antenna is deployed as a horizontal magnetic dipole for overburden depths greater than a skin depth.

The 2000 Hz F1/F1 repeater transceiver provides bidirectional through-the-earth waveguide transmission between the end of a development entry power center or refuse chamber and the surface. Establishes redundant bi-directional transmission link to the surface. Emergency and operational readiness is assured by transmission of tracking, all-call paging and gas monitoring to a 200-kHz mine-wide transmission facility.

A number of radio geophysics considerations affect the performance of any through-the-Earth (TTE) emergency mine communications system. These factors must be taken into account in the basic design of an operational TTE system.

The surface detection of an electromagnetic (EM) signal coming from a trapped miner transmitter and radiating antenna must be of sufficient signal-to-noise ratio to be a factor of four, 12 dB, greater than the magnitude of the surface radio frequency interference (RFI) signal induced in the receiving antenna on the surface. Surface RFI noise arrives at the receiver location by traveling in the ionosphere-Earth waveguide from the location of distant lightning discharges. The surface RFI also includes electric power transmission line unbalanced ground harmonics and other sources of surface current induced energy emissions. Magnetic field RFI spectral density plots of measured data illustrate that the minimum value of such plane wave front EM noise signals occur in a narrow bandwidth around a frequency of 2,000 Hz. For TTE operating frequencies outside of this narrow bandwidth, the noise level increases by several orders of magnitude. Moreover, if the receiving magnetic dipole antenna design does not include an electrostatic shield, the RFI noise level increases by a factor of 10,000, or 80-dB. Even when operating the TTE communication system at 2,000 Hz, the RFI, depending on the overburden depth, is still many factors of ten greater than the EM wave magnetic field component arriving at the Earth's surface from trapped miners.

The EM waves traveling through the stratified material overlying a trapped miner are reflected back into the overlying strata by the impedance contrast of air and the natural overburden media. The transmission loss through the interface reduces the EM field components from a trapped miner by at least a factor of ten, or 20-dB.

At an operating frequency of 2,000 Hz, the attenuation rate of the EM signal is 0.05 dB per foot in typical overlying natural media. Thus, the total attenuation through 2,000 feet of overburden reduces the signal by a factor of 100,000, or 100-dB. The TTE system link budget through 2,000 feet of overburden is attenuated by a factor of $1\times10^6$, or 120-dB. This factor is further increased by RFI noise and the multiplication of the instantaneous noise bandwidth of the receiver.

Any TTE system design approach that attempts to solve the problem by maximizing the radiating antenna magnetic moment faces formidable problems of a very large antenna surface area requirement and very high transmit power levels. A common approach to this problem is overpowering the transmitter antenna. However, this scheme is impractical because overcoming a 10-dB loss requires an increase in transmitter power received by a factor of ten, which quickly becomes impractical in a mine environment. Alternatively, a feasible solution to dealing with the extraordinary high pass transmission loss factor is found in state-of-the-art receiver design, which can be achieved through a gradiometric receiver design.

Electromagnetic gradiometer receivers use co-polarized magnetic dipole antennas to overcome the impacts of surface RFI, surface interface reflections, and natural attenuation of EM signals traveling through the Earth.

The RFI generated during a lightning discharge at a distinct location travels in the ionosphere-Earth waveguide and arrives at the mine site with electric and magnetic field components lying in a vertical plane. Because the electric field component is vertically polarized, an electric charge builds up on the air surface of the Earth interface. This charge buildup causes a smaller horizontal electric field component to lie on the Earth's surface. The horizontally polarized magnetic field of the main lightning strike emission also lies in a vertical plane with the vertical electric field component. The RFI noise ground wave is a quasi-transverse electromagnetic (quasi-TEM) wave. The Poynting vector of the horizontal components is downward directed into the soil and accounts for lightning strike energy attenuation (i.e., absorption) along the radial path from the lightning discharge location to the mine site. The horizontal magnetic field component that is co-polarized with the EM gradiometer resonant magnetic dipole antennas produces equal and opposing polarized electromotive force signals as, $emf_T = emf_1 - emf_2 = 0$ .

The horizontal components of the plane wavefront are cancelled by the differential action of the co-polarized EM gradiometer antenna array. The radiating electric and magnetic field components from a magnetic dipole buried in the-stratified Earth exhibit a spherical spreading wavefront. The wavefront crossing the surface interface undergoes refraction and reflection phenomena with a non-uniform wavefront magnetic filed component intersecting the area vector of each co-polarized resonant magnetic dipole where $emf_1 \neq emf_2$. A Taylor series expansion of the detection problem shows that the distance from the trapped miner is mathematically related to the peak-to-peak separation distance of the gradiometer magnitude response along track over a trapped miner. A 180° phase shift occurs directly over a trapped miner. The communications between a trapped miner and the surface is conducted at one of the peak response points. The EM gradiometer RFI cancellation factor has been measured at 70 dB. Thus, introduction of a gradiometric receiver design reduces the transmitter requirements of the transmitter by many orders of magnitude.

The basic design of the transmitter and antenna of the two-way, TTE emergency communication system is shown in FIG. 3. The transmitters will be located in the existing refuge chambers throughout the mine. In the event that any trapped miners would need to leave a refuge chamber, the transmitter is hand carried for reasonable distances.

A two-way, TTE emergency communication system operates on an alphanumeric text messaging protocol. Messages can be either in the form of brief text or in the form of predetermined coded alerts or instructions. The basic system is extendable to operate with synthetic voice, which is an attractive feature for operation in dusty or smoky conditions.

Although the present invention has been described in terms of the presently preferred embodiments, it is to be understood that the disclosure is not to be interpreted as limiting.

Various alterations and modifications no doubt become apparent to those skilled in the art after having read the above disclosure. Accordingly, it is intended that the appended claims be interpreted as covering all alterations and modifications as fall within the "true" spirit and scope of the invention.

What is claimed is:

1. An improved underground radio communications and personnel tracking system, comprising:

a portable communications device configured for wearing by a miner when underground in a mine;

the improvement comprising:

miner communication gear (102) and a mine management controller (104) configured for automatic mutual communication through various ever-changing media channels available to them including an ionosphere-earth waveguide (106), a layered earth waveguide (107), a coal seam waveguide (108), a conductor/lifeline waveguide (109), and a tunnel waveguide (110);

wherein the miner communication gear (102) includes a cap-lamp transceiver configured for voice and text communication on ultra-low frequency (ULF) to ultra-high frequency (UHF) carrier frequencies and using various kinds of modulation that instantaneously favor at least a particular one of the ionosphere-earth waveguide (106), layered earth waveguide (107), coal seam waveguide (108), conductor/lifeline waveguide (109), and tunnel waveguide (110) radio communication medium and pathway channels;

a cap-lamp transceiver implemented with a software definable transceiver (SDT) for text messaging, voice communication, and tracking with passive radio frequency identification (RFID) tags;

wherein the miner communication gear (102) and mine management controller (104) include transceivers programmed for making selective and agile radio contacts via any of the radio communication medium and pathway channels (106-110) by finding a combination of radio carrier frequency and modulation that supports communication between the miner communication gear (102) and the mine management controller (104) as each independently and unpredictably fades in and out.

2. The system of claim 1, further comprising:

a plurality of narrow-band F1/F1 repeaters for underground placement in said mine, and providing for extended range of communication of the cap-lamp transceiver with radios above ground of the mine;

wherein, the F1/F1 repeaters intercommunicate via said ionosphere-earth waveguide (106), layered earth waveguide (107), coal seam waveguide (108), conductor/lifeline waveguide (109), and tunnel waveguide (110) radio communication medium and pathway channels;

wherein, multi-frequency and modulation capabilities are realized with software-definable transceivers (SDT) and the digital core electronics are shared between the cap-lamp transceivers and F1/F1 repeaters.

3. The system of claim 2, further comprising:

a single magnetic dipole antenna for each F1/F1 repeater.

4. The system of claim 2, further comprising:

a cylindrical enclosure for insertion into a vertical roof borehole and providing protection for an F1/F1 repeater.

5. The system of claim 2, further comprising:

a 2000 kHz F1/F1 repeater and vertical magnetic dipole antenna enclosed in a flame proof enclosure to provide bidirectional through-the-earth waveguide transmission between the end of a development entry power center or refuge chamber and the surface; and a 200-Hz F1/F1 repeater and vertical magnetic dipole antenna enclosed in a flame proof enclosure to provide bidirectional coal seam waveguide transmissions.

6. The system of claim 1, further comprising:

radio frequency identification (RFID) tags encoded with information corresponding to their underground placement in said mine, and providing location information on interrogation; and an RFID tag reader included in the portable communications device, and capable of interrogating nearby RFID tags in said mine and then announcing a location to said miner and to radios above ground of the mine.

7. The system of claim 1, further comprising:

a two-way text messaging device included in the portable communications device, and capable of communicating messages underground with radios above ground of the mine using said ionosphere-earth waveguide (106), layered earth waveguide (107), coal seam waveguide (108), conductor/lifeline waveguide (109), and tunnel waveguide (110) radio communication medium and pathway channels.

8. The system of claim 1, further comprising:

a situation control center configured to track the locations of miners and communicate with them from above ground through the portable communications device via said ionosphere-earth waveguide (106), layered earth waveguide (107), coal seam waveguide (108), conductor/lifeline waveguide (109), and tunnel waveguide (110) radio communication medium and pathway channels.

9. The system of claim 1, further comprising:

an electromagnetic (EM) gradiometer and communications transceiver configured to detect the locations of miners with said cap-lamp transceivers and communicate with them from above ground via said layered earth waveguide (107).

10. The system of claim 1, wherein:

said ionosphere-earth waveguide (106), layered earth waveguide (107), coal seam waveguide (108), conductor/lifeline waveguide (109), and tunnel waveguide (110) radio communication medium and pathway channels are combined into bi-directional, self-healing, transmission paths by a combination of F1/F1 repeaters and Hill-Wait multi-mode lifeline cable; and said layered earth waveguide (107) provides an emergency radio transmission path between the surface and a section power center and refuge chamber, with a F1/F1 repeater providing a redundant communications path to the surface.

11. An underground radio communications and personnel tracking system, comprising:

a portable communications device for wearing by a miner when underground in a mine;

a cap-lamp transceiver included in the portable communications device that provides voice and text communication on ultra-low frequency (ULF) to ultra-high frequency (UHF) carrier frequencies and modulation adapted by programming of a software defined radio to making selective and agile radio contacts via through-the-earth, conductor/lifeline, coal seam, tunnel, and ionosphere/earth-surface waveguides for transmission of electromagnetic waves;

wherein said waveguides comprise layered earth coal and mineral deposits, and manmade mining complex infrastructures which form natural waveguides;

a number of F1/F1 repeaters for underground placement in said mine, and providing for extended range of communication of the cap-lamp transceiver with radios above ground of the mine;

wherein, the ULF F1/F1 repeaters intercommunicate with others via through-the-earth, conductor/lifeline, coal seam, tunnel, and ionosphere/earth-surface waveguides;

a conductor/lifeline cable for supporting Hill-Wait monofilar and bifilar modes of transmission, and that is constructed with a multi-strand steel core with at least two 16-gauge insulated copper conductor wires, and a multi-core fiber optic, all for installation in man and material entries of said mine; and molded way-out Braille indicators with passive RFID tags periodically attached to the conductor/lifeline cable.

12. The system of claim 11, further comprising:

a vertical magnetic dipole (VMD) included in a cap-lamp battery enclosure and configured to create a horizontally polarized electric field component for inducing monofilar current flows in nearby conductor/lifeline cable; and an electrical connection of the extreme ends of loops of the conductor/lifeline cables configured to form a mesh bi-directional transmission network.

13. The system of claim 11, further comprising:

a number of trickle chargers for maintaining a constant charge in batteries supplying the F1/F1 repeaters from a mine section power center via two insulated conductors in the conductor/lifeline cable.

* * * * *